US011591787B2

(12) United States Patent
Say et al.

(10) Patent No.: US 11,591,787 B2
(45) Date of Patent: Feb. 28, 2023

(54) ADJUSTABLE FLOOR DRAIN AND METHOD OF INSTALLATION

(71) Applicant: ZURN INDUSTRIES, LLC, Milwaukee, WI (US)

(72) Inventors: Christopher J. Say, Erie, PA (US); Adam F. Wagner, Lakewood, NY (US); Seth A. Brooks, Syracuse, NY (US); Jason E. Morris, Erie, PA (US)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 143 days.

(21) Appl. No.: 16/928,553

(22) Filed: Jul. 14, 2020

(65) Prior Publication Data

US 2020/0340230 A1 Oct. 29, 2020

Related U.S. Application Data

(63) Continuation of application No. 15/698,985, filed on Sep. 8, 2017, now Pat. No. 10,711,447.
(Continued)

(51) Int. Cl.
*E03F 5/04* (2006.01)
*E04F 17/00* (2006.01)

(52) U.S. Cl.
CPC ..... *E03F 5/0407* (2013.01); *E03F 5/041* (2013.01); *E03F 5/0411* (2013.01);
(Continued)

(58) Field of Classification Search
CPC ..... E03F 5/0407; E03F 5/041; E03F 5/0411; E03F 2005/0412; E03F 2005/0413; E03F 2005/0414; E03F 2005/0415; E04F 17/00
See application file for complete search history.

(56) References Cited

U.S. PATENT DOCUMENTS 1,007,463 A 10/1911 Madden
1,107,094 A 8/1914 Mitchell
(Continued)

FOREIGN PATENT DOCUMENTS

CH 614004 A5 10/1979
CN 2460566 Y 11/2001
(Continued)

OTHER PUBLICATIONS

Office Action issued from the United States Patent Office for U.S. Appl. No. 16/380,039 dated Nov. 13, 2020 (7 Pages).
(Continued)

*Primary Examiner* — Brent W Herring
(74) *Attorney, Agent, or Firm* — Michael Best & Friedrich LLP

(57) ABSTRACT

A drain assembly comprises a shroud, a shank, and a frame. The drain assembly may further comprise a shim with an angled top surface. The frame may have an angled bottom surface. A rotational orientation of the angled top surface of the shim relative to the shank and a rotational orientation of the angled bottom surface of the frame relative to the shank may be independently adjustable, thereby allowing for the top surface of the frame to be both angularly and rotationally adjusted relative to a central axis of the drain assembly independent of the positional height of the shank. The drain assembly may further comprise a cover having bendable tabs. The bendable tabs may be disposed around a periphery of the cover and may be configured to contact an angled inner surface of an upper bowl of the shroud, such that the bendable tabs bend around the frame, thereby locking the cover onto the frame.

18 Claims, 16 Drawing Sheets

Related U.S. Application Data

(60) Provisional application No. 62/462,196, filed on Feb. 22, 2017, provisional application No. 62/396,350, filed on Sep. 19, 2016, provisional application No. 62/393,250, filed on Sep. 12, 2016.

(52) U.S. Cl.
CPC ..... *E03F 2005/0412* (2013.01); *E03F 2005/0413* (2013.01); *E03F 2005/0414* (2013.01); *E03F 2005/0415* (2013.01); *E04F 17/00* (2013.01)

(56) References Cited

U.S. PATENT DOCUMENTS 1,779,936 A 10/1930 Hess
1,792,345 A 2/1931 Williams
1,951,645 A 3/1934 Boosey
1,993,534 A 3/1935 Stoltz
2,121,984 A 6/1938 Rieger et al.
2,190,532 A 2/1940 Lukomski
2,324,545 A 7/1943 Svirsky
2,471,301 A 5/1949 Boosey
2,490,075 A 12/1949 Matheis
2,749,999 A 6/1956 Schmid
2,783,852 A 3/1957 Siak
3,071,781 A 1/1963 Seewack
3,173,443 A 3/1965 Saville
3,285,289 A 11/1966 Titus
3,420,552 A 1/1969 Mork
3,445,973 A 5/1969 Stone
3,703,302 A 11/1972 Dernier, Sr.
3,814,276 A 6/1974 Van Gordon et al.
3,893,919 A 7/1975 Flegel et al.
3,951,172 A 4/1976 Flegel
4,067,072 A 1/1978 Izzi
4,092,745 A * 6/1978 Oropallo ..... E03F 5/0408 4/292
4,233,697 A 11/1980 Cornwall
4,261,824 A 4/1981 Cuschera
4,360,041 A 11/1982 Hagan et al.
4,463,461 A 8/1984 Van Den Broeke et al.
4,614,065 A 9/1986 Papp
4,620,330 A 11/1986 Izzi, Sr.
4,694,513 A 9/1987 Kiziah
4,823,411 A 4/1989 Nettel
4,832,375 A * 5/1989 Emberson ..... F16L 17/025 285/12
4,883,590 A 11/1989 Papp
5,010,957 A 4/1991 Kenner
5,063,718 A 11/1991 Nonis
5,209,257 A 5/1993 Baker, Jr.
5,299,836 A 4/1994 Woods
5,341,523 A 8/1994 Barnes
5,408,706 A 4/1995 Barnes
5,450,868 A * 9/1995 Young, Jr. ..... A47L 15/4208 134/115 G
5,692,248 A 12/1997 Ball
5,695,222 A 12/1997 Hodges
5,745,931 A 5/1998 Ball
5,921,282 A 7/1999 Castillo et al.
6,053,197 A 4/2000 Gorges
6,076,559 A 6/2000 Castillo et al.
6,269,495 B1 8/2001 Sondrup
6,273,124 B1 8/2001 Huber et al.
6,290,279 B1 9/2001 Haight et al.
6,350,373 B1 2/2002 Sondrup
6,361,099 B1 3/2002 McIntosh et al.
6,381,775 B1 5/2002 Sondrup
6,457,901 B1 10/2002 Sondrup
6,687,925 B2 2/2004 Minnick
6,745,408 B2 6/2004 Spella, Sr.
6,755,966 B1 6/2004 Reed
6,763,533 B2 * 7/2004 Mayer ..... E03C 1/22 4/619
6,799,606 B1 10/2004 Howson
6,799,920 B2 10/2004 Sondrup
6,955,499 B2 10/2005 Sondrup
7,213,274 B2 5/2007 Cotton et al.
7,465,888 B2 12/2008 Fischer et al.
7,503,083 B2 3/2009 Ball
7,735,512 B1 6/2010 Ismert et al.
8,096,002 B2 1/2012 Stimpson
8,347,906 B1 1/2013 Ismert et al.
8,566,976 B2 10/2013 Evans et al.
8,607,376 B2 12/2013 Ball
8,658,033 B2 2/2014 Farkas
9,015,870 B2 4/2015 Ball
9,015,876 B2 4/2015 Ball
9,086,174 B2 7/2015 McConnell et al.
9,103,116 B2 8/2015 McConnell et al.
9,366,017 B2 * 6/2016 Cook ..... E03F 5/0408
9,388,570 B2 7/2016 Brown et al.
9,422,707 B2 8/2016 Hull
9,422,708 B2 8/2016 Hull
9,428,900 B2 8/2016 Wroblewski et al.
9,476,199 B2 10/2016 McConnell et al.
9,551,141 B2 1/2017 Clinton et al.
9,869,081 B1 1/2018 Pardo, Jr.
10,167,622 B2 1/2019 Brooks et al.
10,370,841 B2 * 8/2019 Huber ..... E03F 5/0407
10,378,196 B2 * 8/2019 Huber ..... E03F 5/0407
10,683,654 B2 6/2020 Priester
2008/0290012 A1 11/2008 Shih
2008/0308476 A1 * 12/2008 Silverstein ..... E03F 5/06 210/163
2009/0223884 A1 8/2009 Wroblewski
2010/0126917 A1 5/2010 Wroblewski
2011/0173747 A1 * 7/2011 Evans ..... E03F 5/0407 4/679
2012/0036629 A1 * 2/2012 Cook ..... E03F 5/0407 4/613
2012/0036697 A1 * 2/2012 Cook ..... E03F 5/0407 29/428
2013/0193042 A1 8/2013 Hull
2014/0020174 A1 1/2014 Evans et al.
2014/0116527 A1 5/2014 Wroblewski et al.
2014/0130902 A1 * 5/2014 Lucas ..... E03F 5/0407 29/428
2014/0138297 A1 5/2014 Hull
2014/0157514 A1 6/2014 Cook
2015/0121782 A1 5/2015 McConnell et al.
2015/0292662 A1 10/2015 Majocka et al.
2016/0002906 A1 1/2016 Adams
2016/0032578 A1 2/2016 Toms et al.
2017/0130442 A1 5/2017 Brooks et al.
2017/0159278 A1 6/2017 Huber
2017/0247872 A1 8/2017 Huber
2018/0073237 A1 3/2018 Say et al.
2019/0119896 A1 * 4/2019 Priester ..... E03F 5/0407
2019/0242107 A1 * 8/2019 McLeod ..... E03F 5/06

FOREIGN PATENT DOCUMENTS

CN 204590078 A 8/2015
CN 105756093 U 7/2016
DE 3328613 A1 2/1985
DE 3620132 A1 9/1987
EP 0612893 A1 8/1994
EP 1344874 A2 9/2003
EP 1811093 A1 7/2007
KR 200291494 Y1 10/2002
KR 200302234 Y1 2/2003
KR 20050095997 A 10/2005

OTHER PUBLICATIONS

American Society of Mechanical Engineers, Floor and Trench Drains, ASME A112.6.3-2001, 2001, 13 pages.
Blucher, Drainage Systems—Product Catalogue for Drains, Pipes and Channels, Copyright by Blucher, 2000, 162 pages.

(56) References Cited

OTHER PUBLICATIONS

Mifab, F1100-C-T Floor Drain With Spanner Wrench Cover For Membrane Floor Areas, 2001, 1 page.
Mifab Engineered Plumbing and Drainage Products Price Guide, MPF-2004, 2004, 17 pages.
ProSet Systems, Excerpts from ProSet Systems' ProSeal Closet Assembly, 2002, 9 pages.
Sioux Chief Manufacturing Company, Specification Guide for Drainage Products, 2004, 7 pages.
Jay R. Smith Mfg. Co., Excerpts from Product Guide, Copyright 2002 Jay R. Smith Mfg. Co., 3 pages.
Tyler Pipe/ Wade Division, Drawing: Adjustable Floor Drain, 900-C, Apr. 2, 2003, 1 page.
Tyler Pipe/ Wade Division, Excerpts from Wade Plumbing Products' Specification Drainage Products, Aug. 18, 2003, 6 pages.
Zurn Plumbing Products Group, Specification Drainage Engineering Guide, Floor Drains, 5 pages.
Zurn, Cast Iron EZ1(TM) Nomenclature Decoder, Specification Drain Customer Guide, Oct. 1, 2018, 1 page.
Zurn, EZ1(TM)-6 6" Top Assembly Adjustable Floor Drain with EZ1(TM) Technology Specification Sheet, Oct. 24, 2017, 1 Page.
Zurn, EZ1 (Tm) Drainage Series—EZ1 (TM) Floor Drain Installation Instructions, Nov. 6, 2017, 6 pages.

* cited by examiner

ADJUSTABLE FLOOR DRAIN AND METHOD OF INSTALLATION

CROSS-REFERENCE TO RELATED APPLICATIONS

This application is a continuation of U.S. patent application Ser. No. 15/698,985, filed on Sep. 8, 2017, which claims priority to U.S. Provisional Patent Application No. 62/393,250 filed on Sep. 12, 2016, U.S. Provisional Patent Application No. 62/396,350 filed on Sep. 19, 2016, and U.S. Provisional Patent Application No. 62/462,196 filed on Feb. 22, 2017, the contents of which are incorporated herein by reference in their entireties for all purposes.

STATEMENT OF FEDERALLY SPONSORED RESEARCH OR DEVELOPMENT

Not applicable.

TECHNICAL FIELD

This application relates generally to floor drains. More specifically, this application relates to a floor drain which is adjustable in height and pitch to allow the top of the floor drain to conform to the pitch of a surrounding floor surface. Furthermore, this application is directed toward installing an adjustable floor drain with a cover.

BACKGROUND

Floor drains are installed in low points of floors to collect and provide a drain passage for fluid. Such floor drains are typically connected to a drain pipe. Traditionally, floor drains provide a rigid housing that must be accurately set when pouring a concrete floor to ensure that the drain is aligned with the angle of the floor. Additionally, inconsistencies in the concrete pour, or out of level flooring situations, must be accounted for or adjusted to when the finished floor surface is installed.

In many instances, it may be desirable to independently adjust the angle, rotation, and height of the floor drain. Further, it may be desirable to install a floor drain such that the floor drain remains clean (i.e., free of cement) throughout the installation process.

SUMMARY

Adjustable floor drains, though shown in the prior art, have not shown a robust solution to the need for independent angular, rotational, and height adjustment. Furthermore, a cover which can be easily coupled to a floor drain during installation and removed thereafter can allow for the floor drain to remain clean throughout the installation process.

Disclosed herein is an improved drain assembly that allows for independent angular, rotational, and height adjustment, while providing a clean floor drain after installation.

According to one aspect, a drain assembly comprises a shroud, a shank, a frame, a shim, and a clamp. The shroud has a threaded radially inward facing surface. The shank has a lip on an upper edge, a cylindrical radially inward facing surface defining a central axis, and a threaded radially outward facing surface configured to threadably engage the threaded radially inward facing surface of the shroud. The frame has a top surface and an angled bottom surface. The angled bottom surface is angled relative to the central axis.

The shim has an angled top surface, which is angled relative to the central axis. The clamp is configured to clamp the shim between the lip of the shank and the angled bottom surface of the frame. Additionally, a rotational orientation of the angled top surface of the shim relative to the shank and a rotational orientation of the angled bottom surface of the frame relative to the shank are independently adjustable. This independent adjustability allows for the top surface of the frame to be both angularly and rotationally adjusted relative to the central axis.

Furthermore, the top surface of the frame can be both angularly and rotationally adjusted relative to the central axis independent of the axial height of the top surface of the frame. The angled bottom surface of the frame and the angled top surface of the shim may bear on one another. A bottom surface of the shim may bear against the lip of the shank. In some instances, the frame, the shim, and the clamp may each have an annular shape. In some other instances, the top surface of the frame may have a rectangular shape.

The drain assembly may further comprise a cover having bendable tabs disposed around a periphery of the cover. The bendable tabs may be configured to contact an angled inner surface of an upper bowl of the shroud when the threaded radially outward facing surface of the shank is threadably engaged with the threaded radially inward facing surface of the shroud such that the bendable tabs bend around the frame, thereby locking the cover onto the frame.

In some instances, a radially inward facing surface of the shim may include a tab extending radially inward from the radially inward facing surface toward the central axis. The tab may accommodate rotational adjustment of the shim about the central axis. A radially inward facing surface of the shank may also include a tab extending radially inward from the radially inward facing surface toward the central axis. The tab of the shank may provide a reference point for use with the tab of the shim to allow for precise rotational adjustment of the shim about the central axis.

The drain assembly may further comprise a grate and a grate cover. The grate may be coupled to the top surface of the frame. The grate cover may be removably coupled to a top surface of the grate.

According to another aspect, a drain assembly comprises a shroud, a shank, a frame, and a cover. The shroud includes a threaded radially inward facing surface and an upper bowl. The upper bowl has an angled inner surface. The shank has a lip on an upper edge, a cylindrical radially inward facing surface defining a central axis, and a threaded radially outward facing surface configured to threadably engage the threaded radially inward facing surface of the shroud. The frame is coupled to the lip of the shank. The cover has bendable tabs disposed around a periphery of the cover. Additionally, the bendable tabs are configured to contact the angled inner surface of the upper bowl of the shroud when the threaded radially outward facing surface of the shank is threadably engaged with the threaded radially inward facing surface of the shroud such that the bendable tabs bend around the frame, thereby locking the cover onto the frame.

In some instances, the drain assembly may further comprise a shim and a clamp. The shim may have an angled top surface angled relative to the central axis. The clamp may be configured to clamp the shim between the lip of the shank and the frame. Additionally, the frame may include a top surface and an angled bottom surface angled relative to the central axis. A rotational orientation of the angled top surface of the shim relative to the shank and a rotational orientation of the angled bottom surface of the frame relative to the shank may be independently adjustable, thereby allowing for the top surface of the frame to be both angularly and rotationally adjusted relative to the central axis. In these instances, the top surface of the frame can be both angularly and rotationally adjusted relative to the central axis independent of the axial height of the top surface of the frame. The angled bottom surface of the frame and the angled top surface of the shim may also bear on one another.

In some other instances, the cover may further comprise a plurality of hollow protrusions disposed around the periphery of the cover. Additionally, the frame may include slots configured to receive the bendable tabs when the bendable tabs bend around the frame, such that when the bendable tabs are within the slots, the cover is rotationally coupled to the frame. Each of the plurality of hollow protrusions may further be configured for engagement with a tool, such that the cover, the frame, and the shank may be rotatable with the tool when the tool is engaged with at least one of the hollow protrusions, allowing for removal of the shank from the shroud after installation. In these instances, when the cover, the frame, and the shank are rotated to remove the shank from the shroud, the bendable tabs of the cover may be configured to bend away from the frame, allowing for removal of the cover after installation.

In yet some other instances, the drain assembly may further comprise a grate and a grate cover. The grate may be coupled to the top surface of the frame. The grate cover may be removably coupled to a top surface of the gate.

According to another aspect, a method of installing a drain assembly onto a pipe in a concrete floor, in which the drain assembly includes a shroud, a shank adjustably coupled to the shroud along their axial directions, a grate coupled to a top axial end of the shank, and a cover positioned over the grate and temporarily locked in place by a relative positioning of the shank relative to the shroud is provided. The method comprises pouring concrete around the drain assembly and allowing the concrete to set around the drain assembly. The method further comprises adjusting, at least in part, a position of the shank relative to the shroud to unlock the cover from the drain assembly to permit the cover to be lifted from the grate. The method further comprises removing the cover from the grate to expose the grate therebeneath.

In some instances, the method may further comprise inserting a shim between the shank and the grate, wherein the shim is configured to angularly adjust the grate relative to a central axis of the drain assembly.

In some other instances, the cover may be configured to withstand a load of at least three thousand pounds.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
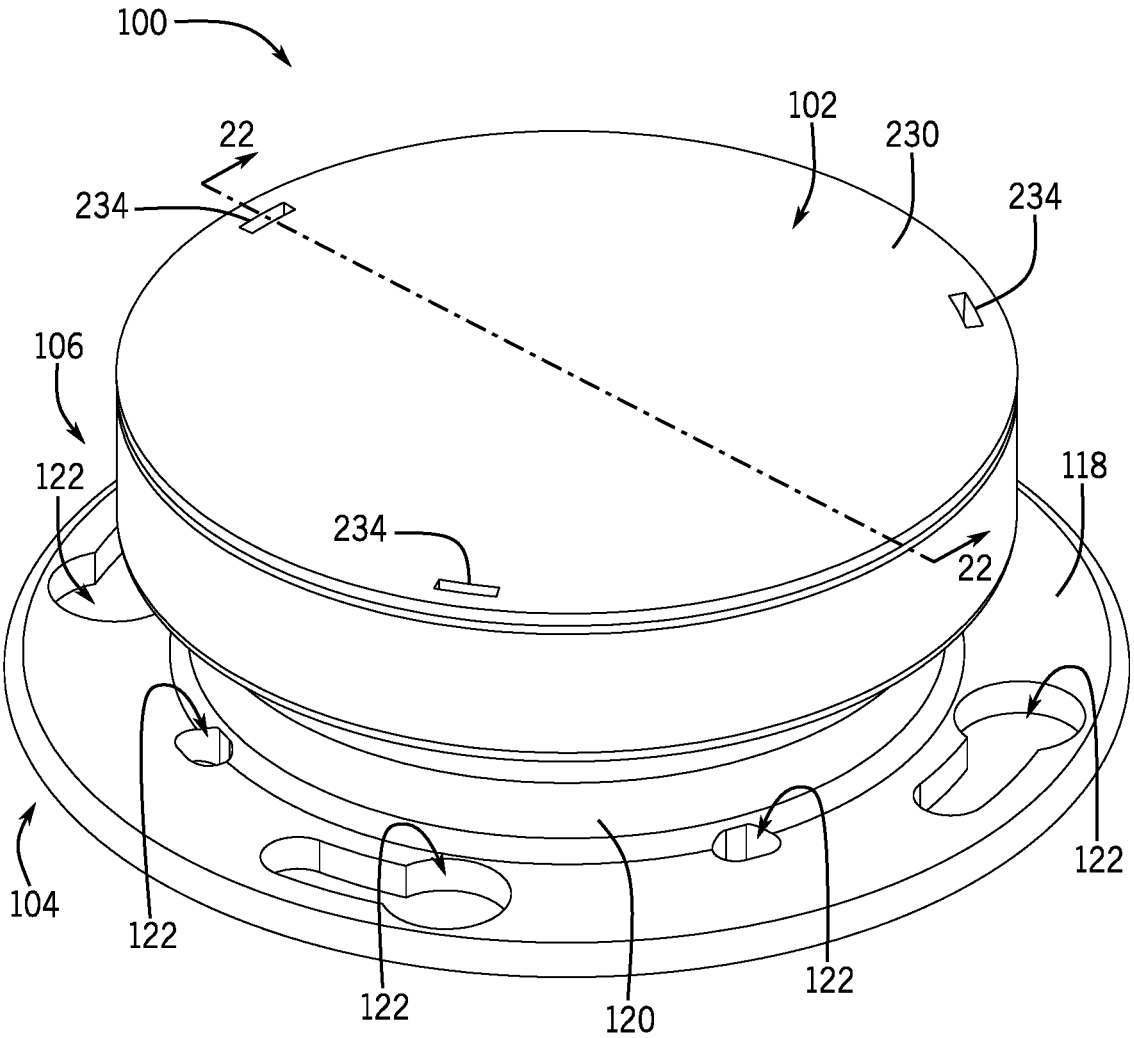
FIG. 1 is a front, top perspective view of a floor drain assembly.

Referring to FIG. 1, a floor drain assembly 100 is illustrated. A floor drain assembly 100 of this type can be used to provide a drain passage for fluid and may be adjusted to match the height and pitch of a surrounding floor surface. Additionally, the floor drain assembly 100 can be installed with a cover 102 that can prevent cement from contacting the interior channel of the floor drain assembly 100.

Figure 2:
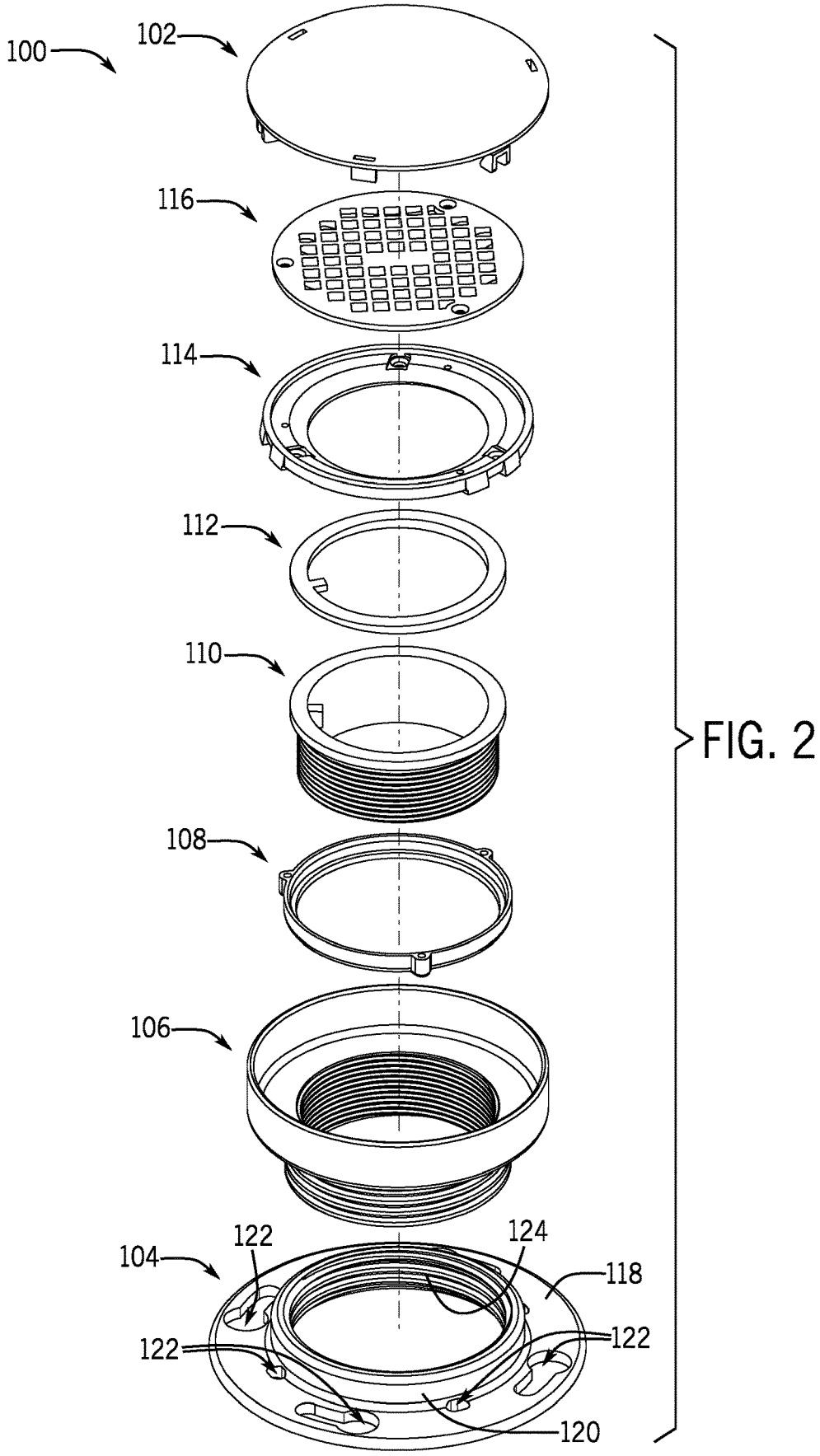
FIG. 2 is a front, top exploded perspective view of the floor drain assembly shown in FIG. 1.

FIGS. 1 and 2 illustrate the floor drain assembly 100. The floor drain assembly 100 includes a base 104, a shroud 106, a clamp 108, a shank 110, a shim 112, a frame 114, a grate 116, and the cover 102. The base 104 includes a bottom flange 118 and a base body 120. The bottom flange 118 includes a plurality of attachment apertures 122 configured to attach the bottom flange 118 to any of a multitude of various drain pipes (not shown). The base body 120 defines a cylindrical shape and includes a threaded radially inward facing surface 124.

Figure 3:
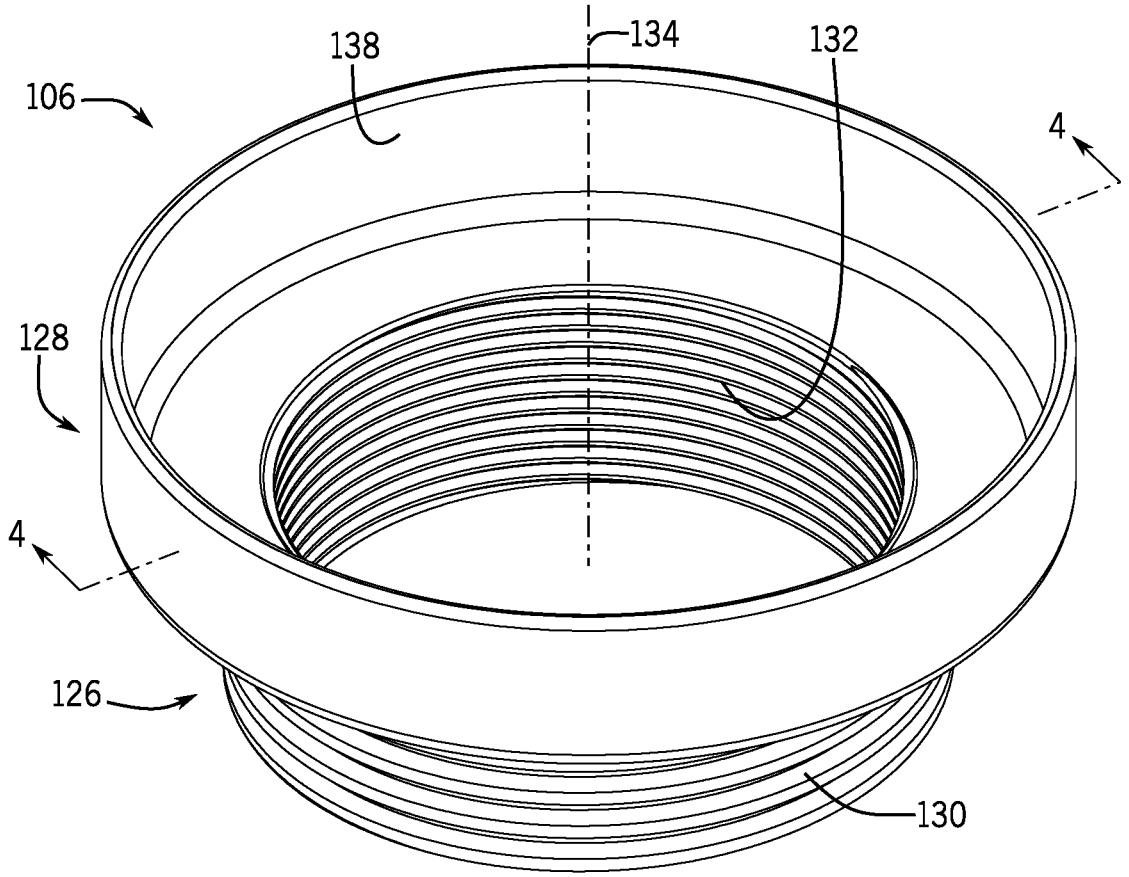
FIG. 3 is a front, top perspective view of a shroud of the floor drain assembly shown in FIG. 1.
Figure 4:
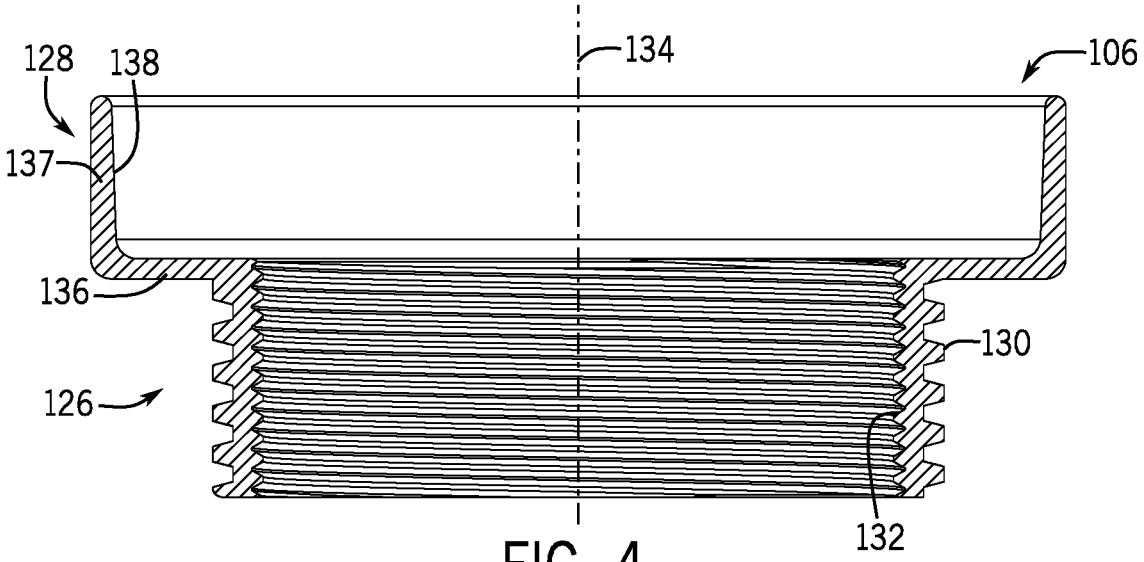
FIG. 4 is a cross-sectional view of the shroud shown in FIG. 3, taken along line 4-4.

FIGS. 3 and 4 illustrate the shroud 106 in greater detail. The shroud 106 includes a lower shroud body 126 and an upper bowl 128. The shroud body 126 defines a cylindrical shape and includes a threaded radially outward facing surface 130 configured to threadably engage the threaded radially inward facing surface 124 of the base 104. The shroud body 126 further includes a threaded radially inward facing surface 132 defining a central axis 134.

The upper bowl 128 includes a radially extending wall 136, extending radially outward from a top edge of the shroud body 126. The upper bowl further includes an axially extending wall 137 extending axially upward from an outermost edge of the radially extending wall 136 and circumferentially around the entire radially extending wall 136. The axially extending wall 137 includes an angled inner surface 138, which is angled with respect to the central axis 134.

Figure 5:
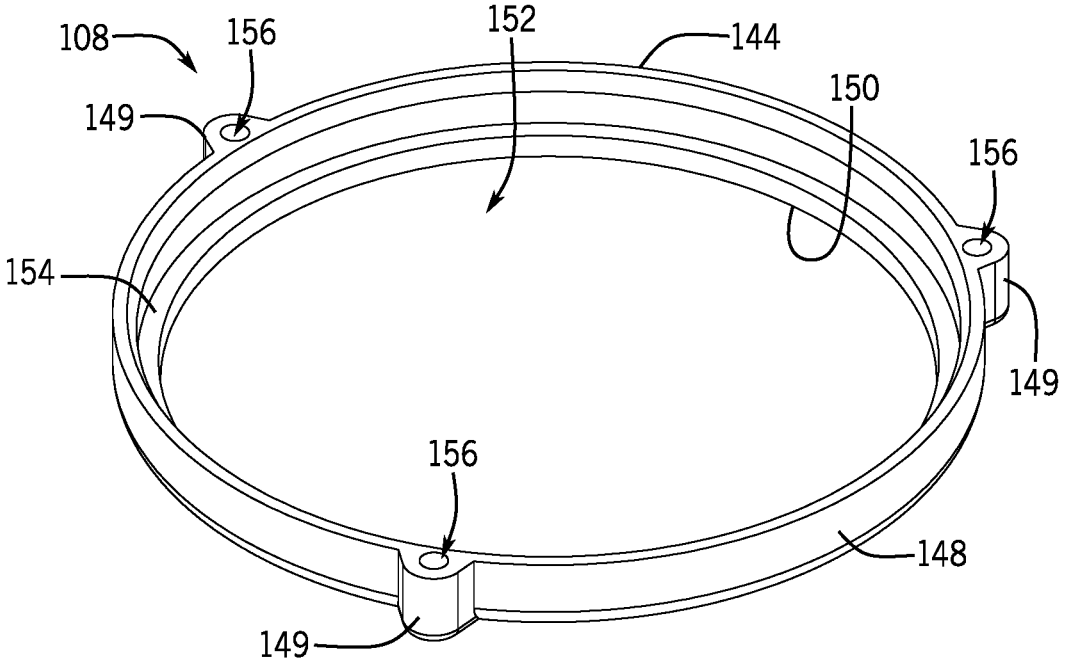
FIG. 5 is a front, top perspective view of a clamp of the floor drain assembly shown in FIG. 1.

FIG. 5 illustrates the clamp 108. The clamp 108 defines an annular shape and includes a top surface 144, a bottom surface 146 (shown in FIG. 21), a radially outward facing surface 148, three mounting features 149, and a radially inward facing surface 150 defining a central opening 152. The clamp 108 further includes a recessed portion 154 recessed into the top surface 144 toward the bottom surface 146 and surrounding the central opening 152. An innermost edge of the top surface 144, surrounding the recessed portion 154, is also slightly chamfered.

The three mounting features 149 extend radially outward from the radially outward facing surface 148 of the clamp 108 and are spaced circumferentially around the clamp 108. The three mounting features 149 each include a mounting aperture 156 configured to receive a fastener 158 (shown in FIGS. 19, 20, and 22).

Figure 6:
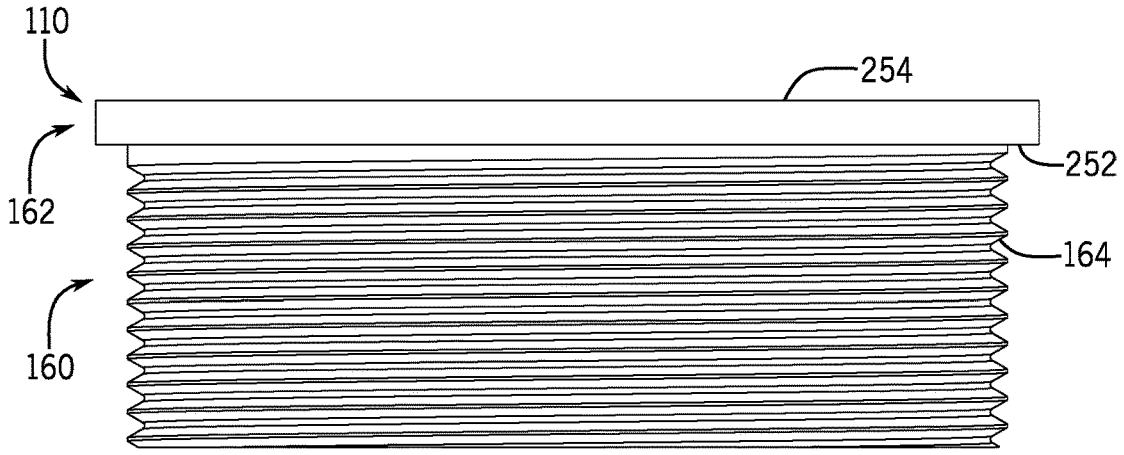
FIG. 6 is a front elevational view of a shank of the floor drain assembly shown in FIG. 1.
Figure 7:
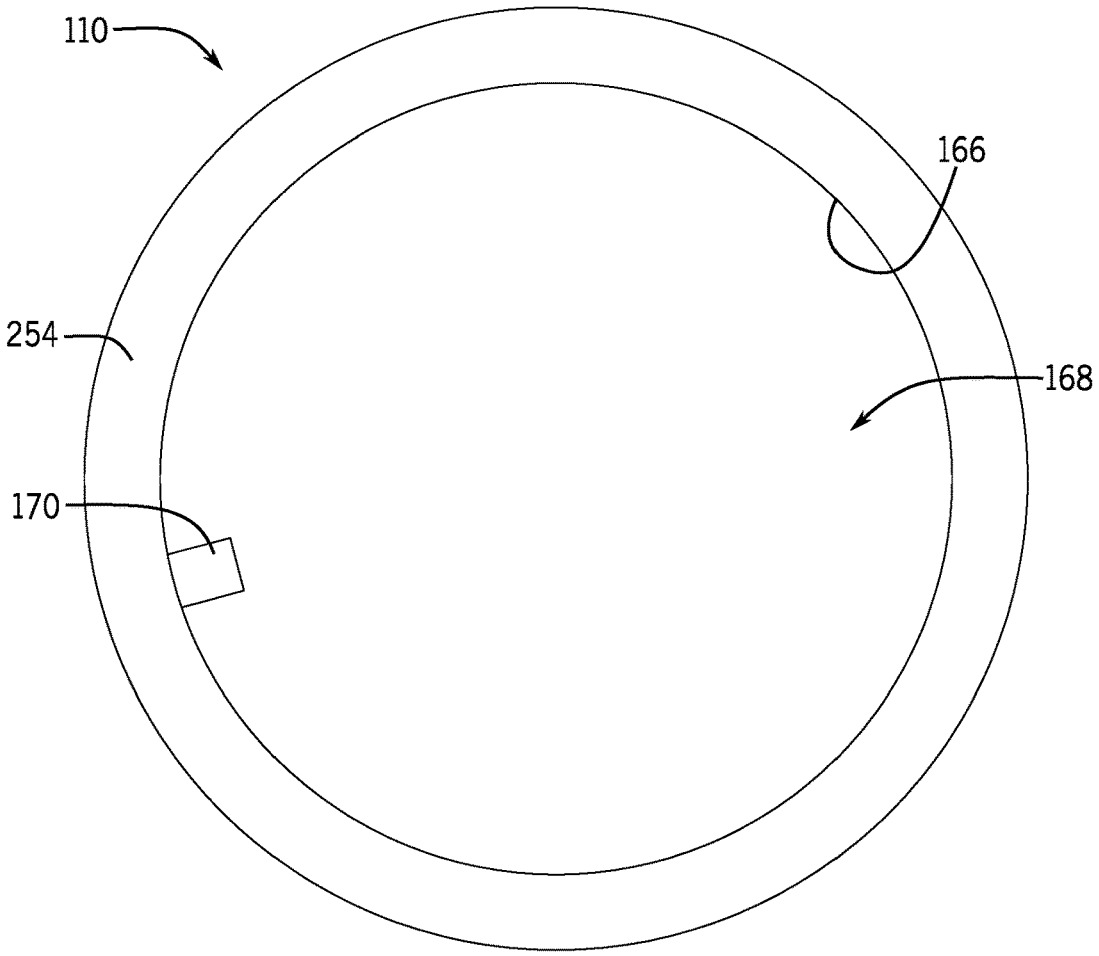
FIG. 7 is a plan view of the shank of FIG. 6.

FIGS. 6 and 7 illustrate the shank 110. The shank 110 includes a shank body 160 and a lip 162 at an axial upper end thereof. The shank body 160 includes a threaded radially outward facing surface 164 configured to threadably engage the threaded radially inward facing surface 132 of the shroud 106. The shank body 160 further includes a radially inward facing surface 166 defining a central opening 168. The radially inward facing surface 166 of the shank body 160 further includes a shank tab 170 extending radially inward from the radially inward facing surface 166 of the shank body 160 toward the central axis 134. The lip 162 is disposed on an upper edge of the shank body 160 and extends radially outward from the shank body 160.

Figure 8:
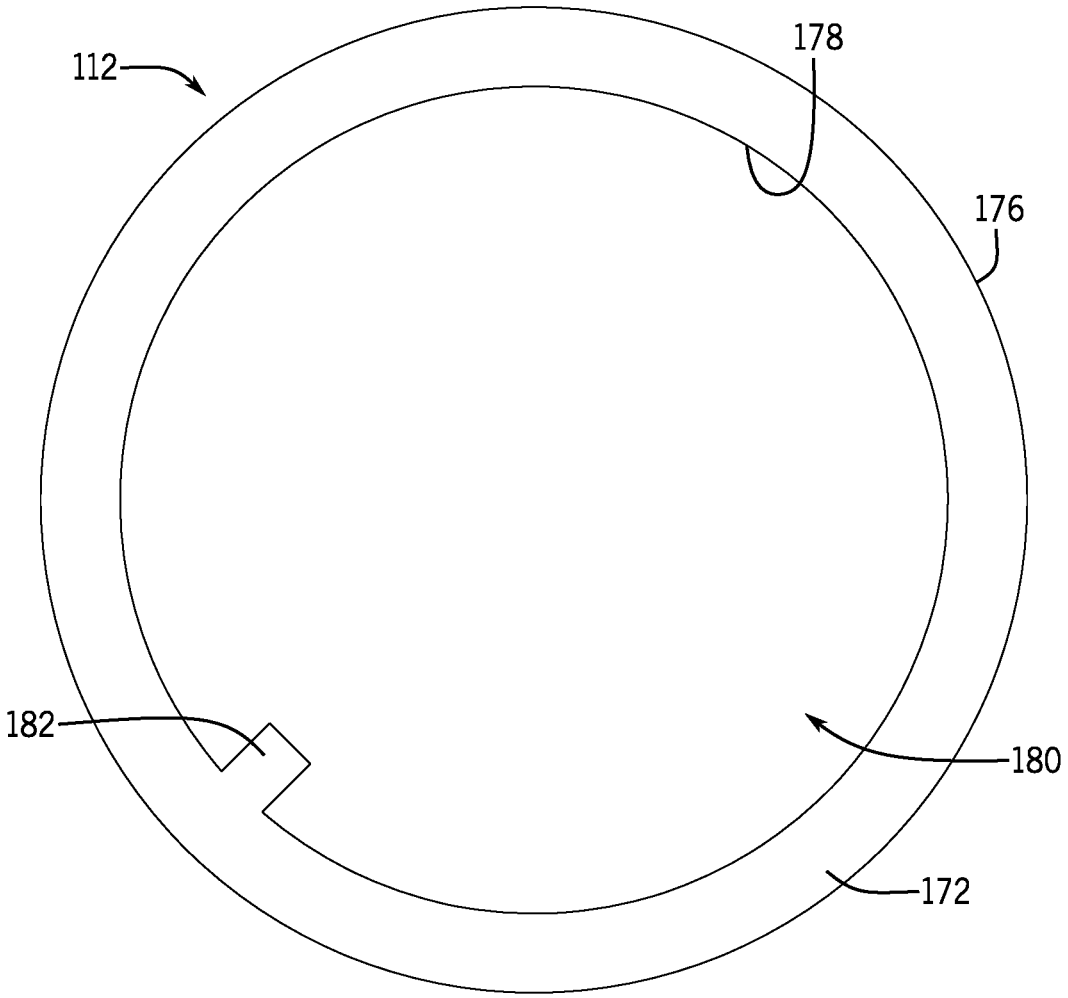
FIG. 8 is a plan view of a shim of the floor drain assembly shown in FIG. 1.
Figure 9:
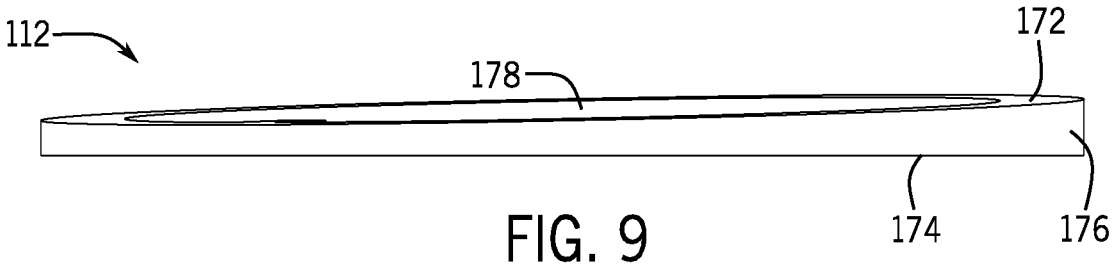
FIG. 9 is a front elevational view of the shim of FIG. 8.

FIGS. 8 and 9 illustrate the shim 112. The shim 112 includes an angled top surface 172, a bottom surface 174, a radially outward facing surface 176, and a radially inward facing surface 178 defining a central opening 180. The angled top surface 172 is angled with respect to the central axis 134. The radially inward facing surface 178 includes a shim tab 182 extending radially inward from the radially inward facing surface 178 of the shim 112.

Figure 10:
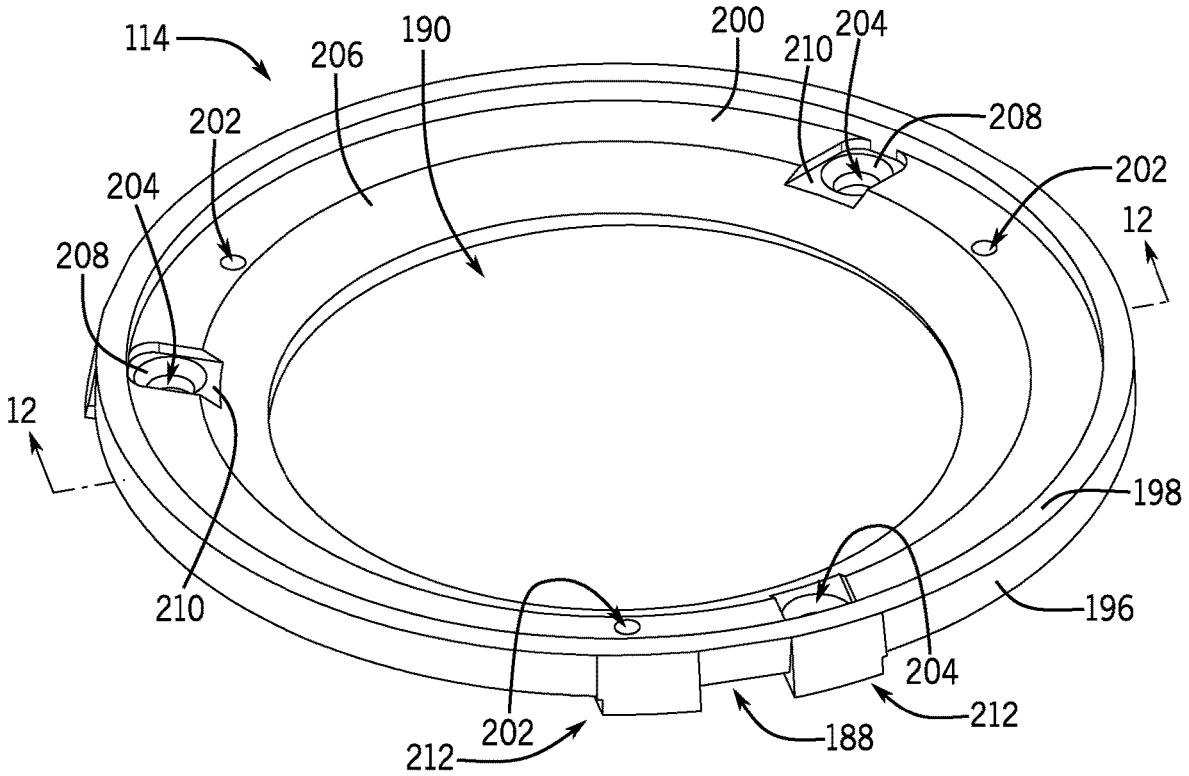
FIG. 10 is a front, top perspective view of a frame of the floor drain assembly shown in FIG. 1.
Figure 11:
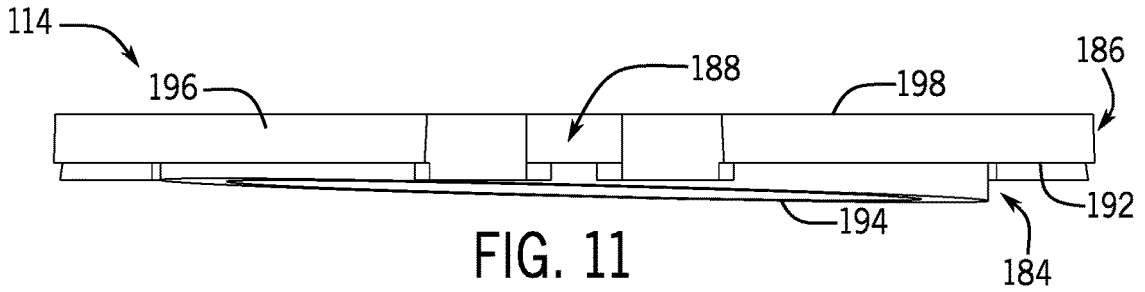
FIG. 11 is a front elevational view of the frame of FIG. 10.
Figure 12:
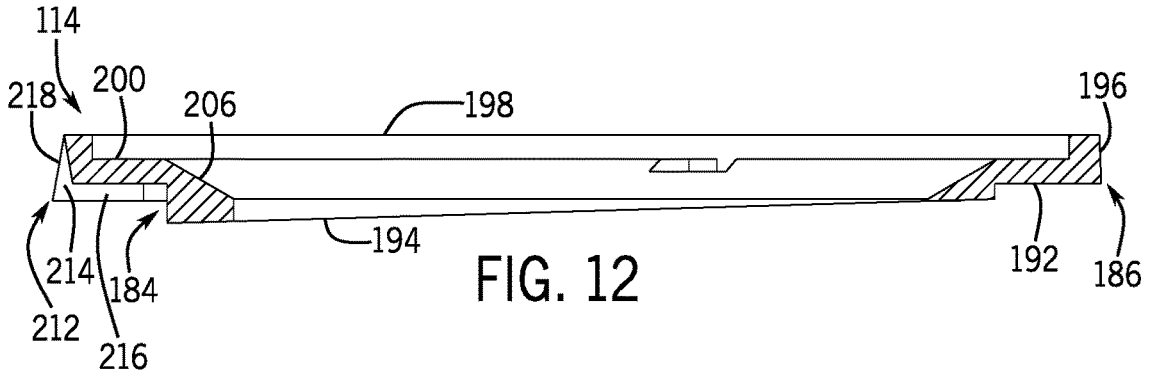
FIG. 12 is a cross-sectional view of the frame of FIG. 10, taken along line 12-12.

FIGS. 10, 11, and 12 illustrate the frame 114. The frame 114 includes a lower portion 184, an upper portion 186, three slots 188, and a central opening 190 extending through the lower portion 184 and the upper portion 186, such that the frame 114 has an annular shape. The lower portion 184 is approximately the same diameter as the shim 112 and extends axially from a bottom surface 192 of the upper portion 186. The lower portion 184 further includes an angled bottom surface 194 that is angled with respect to the central axis 134 at the same angle as the angled top surface 172 of the shim 112.

The upper portion 186 of the frame 114 further includes a radially outward facing surface 196, a top surface 198, and a recessed surface 200 recessed into the top surface 198 toward the bottom surface 192. The recessed surface 200 includes three clamp mount apertures 202, three grate mount apertures 204, and a chamfer 206 on an innermost edge. Each of the clamp mount apertures 202 and the grate mount apertures 204 extends through the frame 114 from the recessed surface 200 to the bottom surface 192 and are configured to receive the fasteners 158. The clamp and grate mount apertures 202, 204 are further clustered into three pairs, each pair consisting of one clamp mount aperture 202 and one grate mount aperture 204. The three pairs are spaced circumferentially around the upper portion 186. Each of the grate mount apertures 204 further includes a chamfered edge 208 and is surrounded by a grate mount recession 210. The chamfer 206 on the innermost edge surrounds the central opening 190 and extends partially into the lower portion 184, as best illustrated in FIG. 12.

The three slots 188 are spaced circumferentially around the frame 114 and are formed between three pairs of slot protrusions 212. The slot protrusions 212 have a radially outward facing portion 214 and an axially downward facing portion 216. The radially outward facing portion 214 has an angled outer surface 218 that is angled with respect to the central axis 134. A top edge of the angled outer surface 218 of the slot protrusions 212 sits flush with a top edge of the radially outward facing surface 196 of the upper portion 186 and a bottom edge of the angled outer surface 218 extends radially beyond the bottom edge of the radially outward facing surface 196 of the upper portion 186. The axially downward facing portion 216 extends axially downwards from the bottom surface 192 of the upper portion 186.

Figure 13:
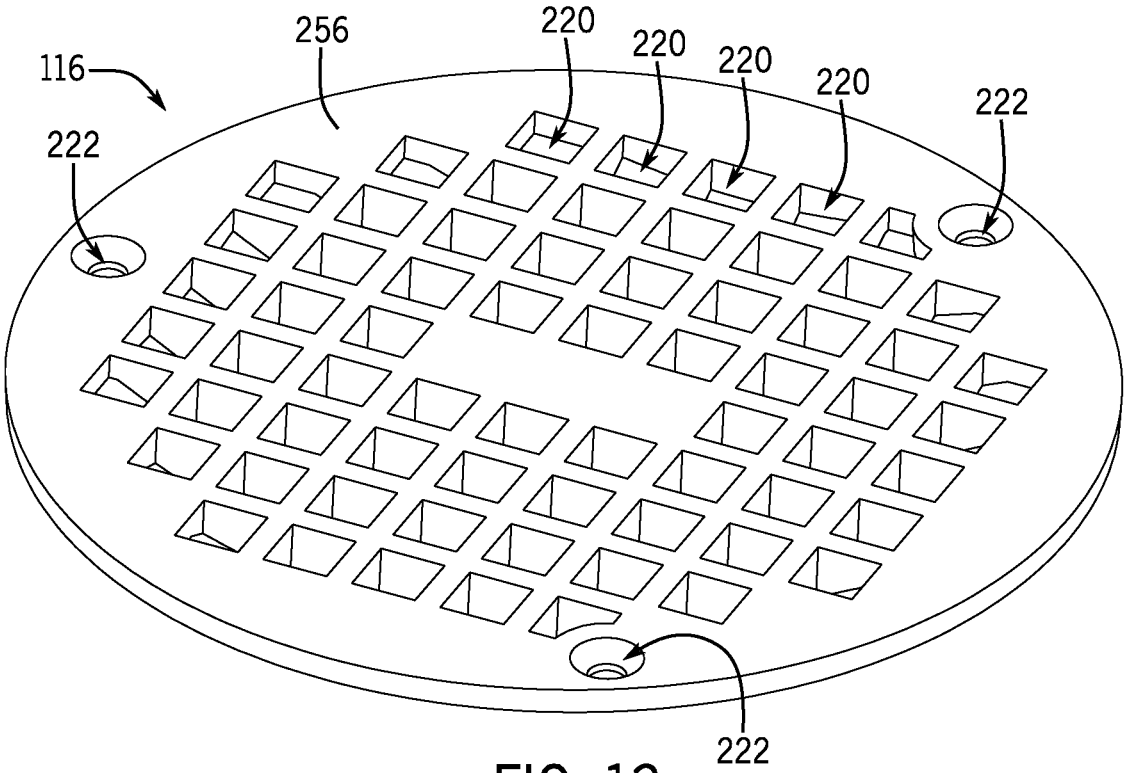
FIG. 13 is a front, top perspective view of a grate of the floor drain assembly shown in FIG. 1.

FIG. 13 illustrates the grate 116. The grate 116 includes a plurality of small openings 220 and three grate mount apertures 222. The plurality of small openings 220 are configured to permit the passage of fluid, while preventing large objects and debris through the grate 116. The three grate mount apertures 222 of the grate 116 are configured to align with the three grate mount apertures 204 of the frame 114, and are further configured to receive the fasteners 158.

Figure 14:
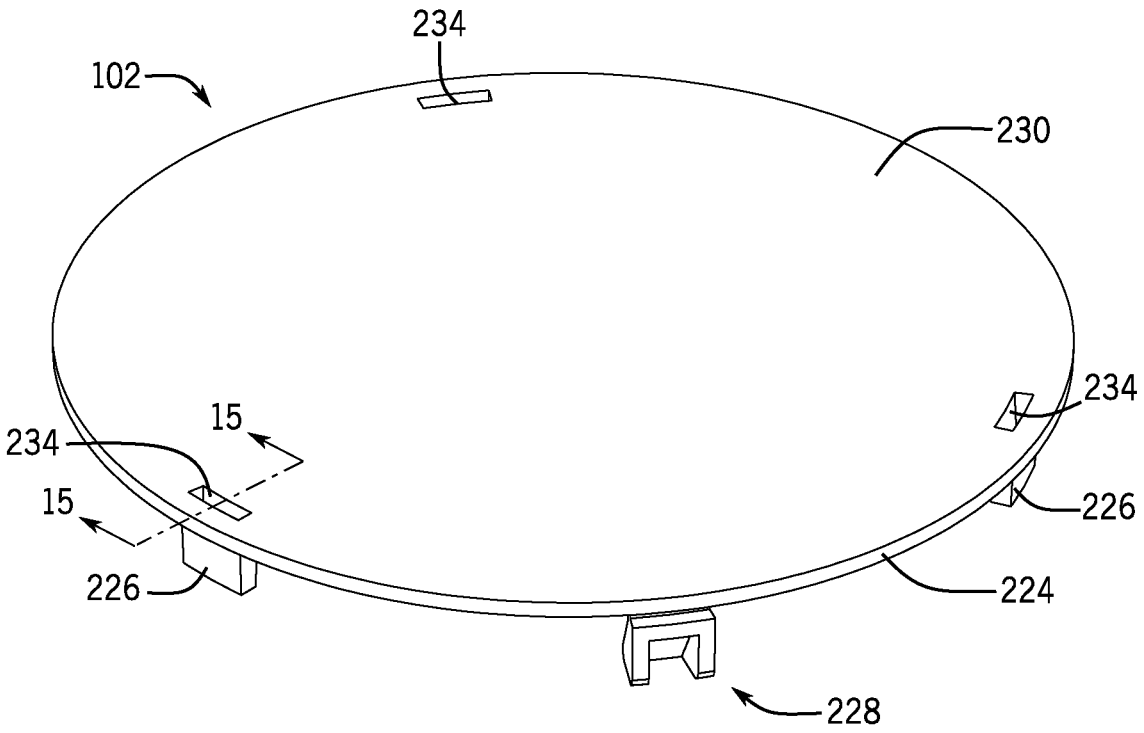
FIG. 14 is a front, top perspective view of a cover of the floor drain assembly shown in FIG. 1.
Figure 15:
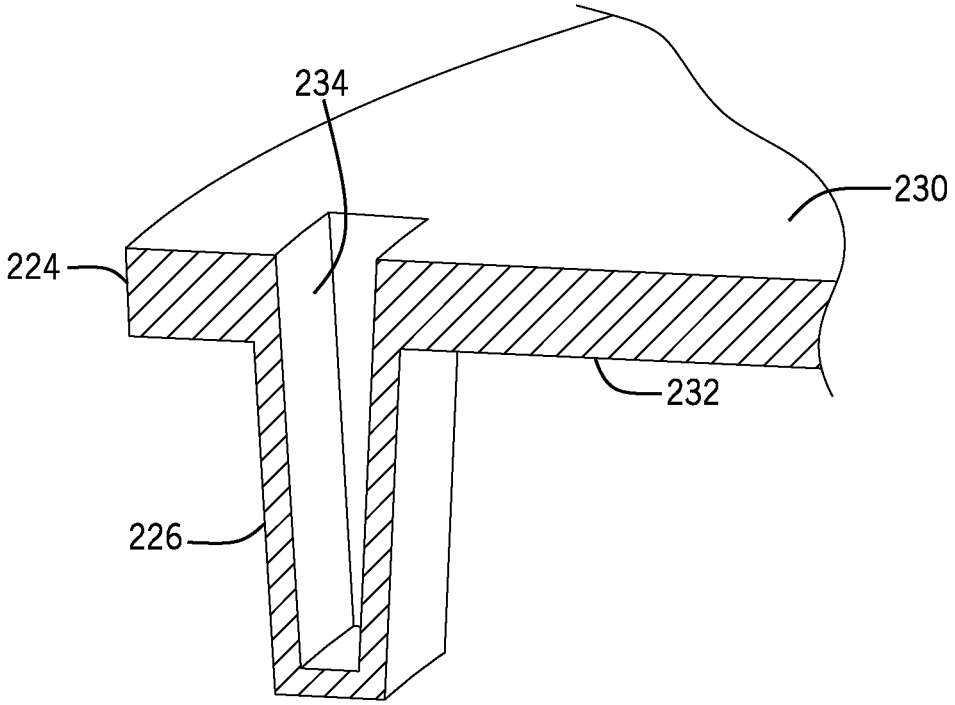
FIG. 15 is a detailed cross-sectional view of a hollow protrusion of the cover shown in FIG. 14, taken along line 15-15.

FIG. 14 illustrates the cover 102. The cover 102 includes a cover plate 224, three hollow protrusions 226, and three bendable tabs 228. The cover plate 224 includes a top surface 230 and a bottom surface 232. The three hollow protrusions 226 each protrude away from the bottom surface 232 of the cover plate 224 and include a central recess 234. The central recess 234 of each hollow protrusion 226 is recessed into the top surface 230 of the cover plate 224 and extends throughout the corresponding hollow protrusion 226, as best shown in FIG. 15.

Figure 16:
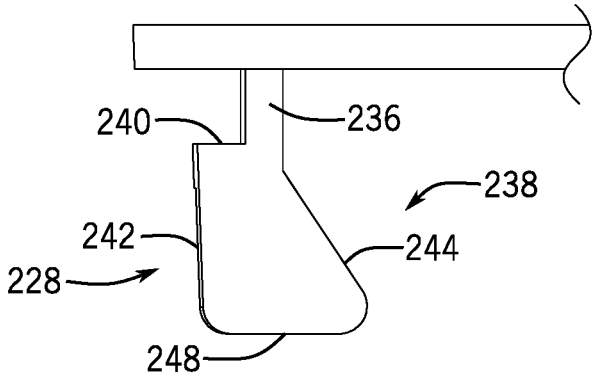
FIG. 16 is a detailed right elevational view of a bendable tab of the cover shown in FIG. 14.
Figure 17:
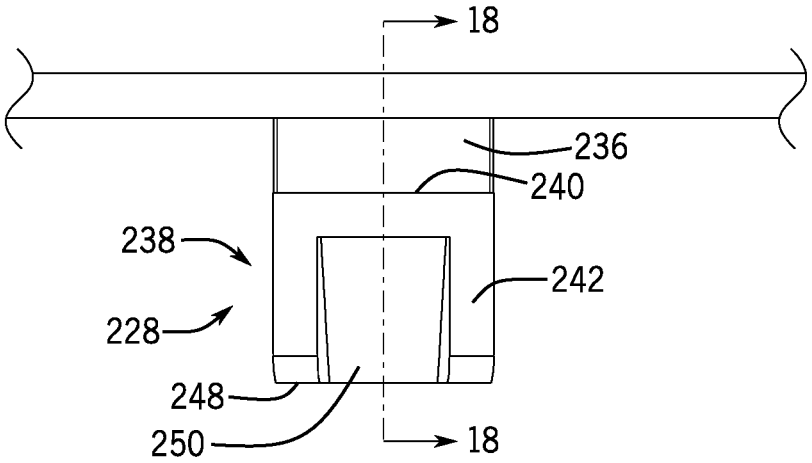
FIG. 17 is a detailed front elevational view of the bendable tab of FIG. 16.
Figure 18:
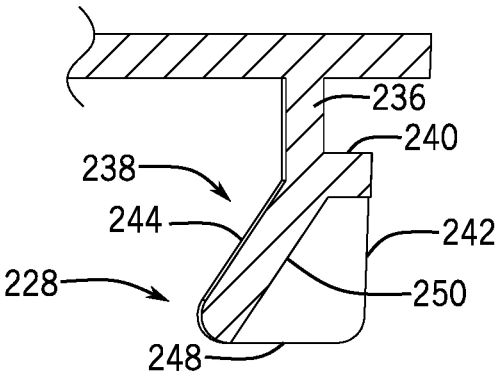
FIG. 18 is a detailed cross-sectional view of the bendable tab of FIG. 17, taken along line 18-18.

FIGS. 16-18 illustrate one of the bendable tabs 228. The bendable tab 228 includes an axial extension 236 and a frame engagement portion 238. The axial extension 236 extends axially downward from the bottom surface 232 of the cover plate 224 and connects to a top surface 240 of the frame engagement portion 238. The frame engagement portion 238 further includes a shroud engagement surface 242, an angled radially inward facing surface 244, and a bottom surface 248. Additionally, the frame engagement portion 238 includes an angled recess 250 that is recessed into both the shroud engagement surface 242 and the bottom surface 248 toward both the top surface 240 and the angled radially inward facing surface 244. As illustrated in FIGS. 16-18, the tabs 228 are shown in a slightly axially inwardly bent state in which they have been flexed inward; however, it will be appreciated that they may initially be in a slightly outward configuration, thereby resulting in engagement with the shroud 106, as described below.

It should be appreciated that, although the illustrated frame 114 and the grate 116 have a generally annular shape, the frame 114 and the grate 116 could alternatively define any of square, rectangular, triangular, or any other suitable shapes.

Now that the general structure of the floor drain assembly 100 and its various parts have been described above, a method for assembling the floor drain assembly 100 will be described below.

Figure 19:
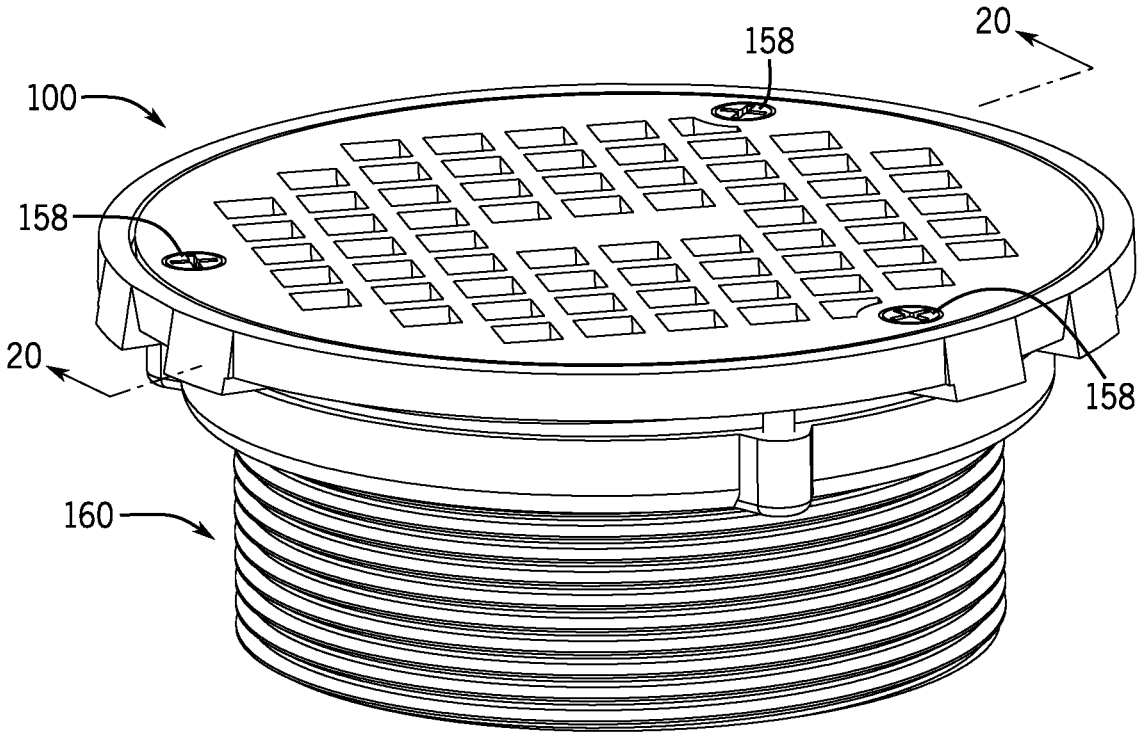
FIG. 19 is a front, top perspective view of the floor drain assembly of FIG. 1, partially assembled, including the clamp, the shank, the shim, the frame, and the grate.
Figure 20:
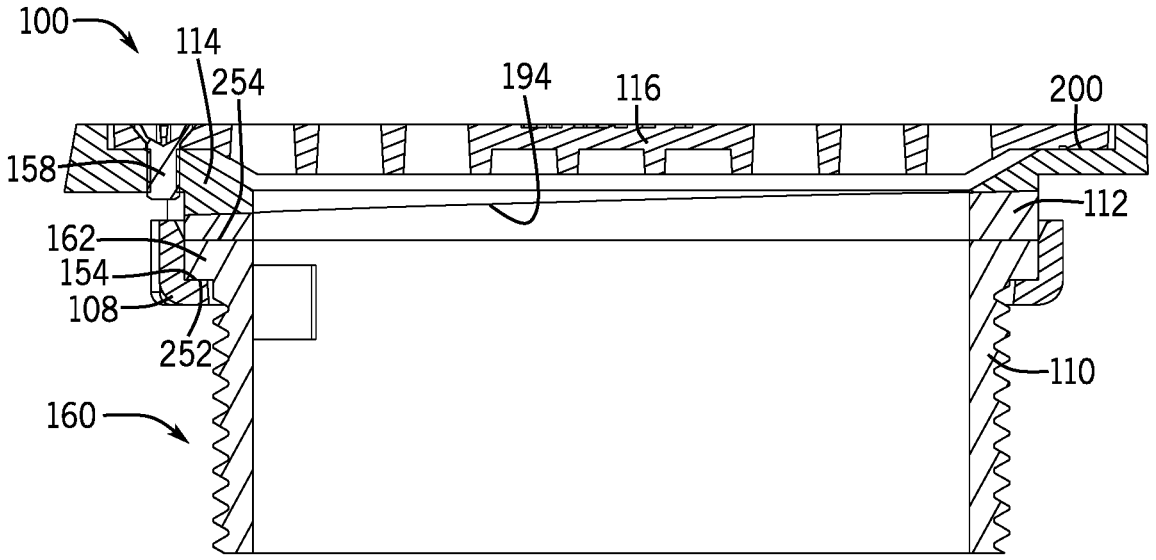
FIG. 20 is a cross-sectional view of the partially assembled floor drain of FIG. 19, taken along line 20-20.

FIGS. 19 and 20 illustrate a partially assembled floor drain assembly 100. When assembling the floor drain assembly 100, the shank body 160 can be fed through the central opening 152 of the clamp 108 until a bottom surface 252 of the lip 162 contacts the recessed portion 154 of the clamp 108. Because the lip 162 extends radially beyond the rest of the shank body 160, the lip 162 prohibits the shank 110 from entirely passing through the clamp 108.

The shim 112 can then be placed between a top surface 254 of the lip 162 of the shank 110 and the angled bottom surface 194 of the frame 114. With the shim 112 between the frame 114 and the shank 110, the frame 114 and the clamp 108 can then be fastened to the shank 110 with the fasteners 158 through both the mounting apertures 156 of the clamp 108 and the clamp mount apertures 202 of the frame 114, rigidly fixing the frame 114, the shim 112, and the clamp 108 onto the shank 110. Further, by fastening the frame 114 to the shank 110 with the shim 112 disposed therebetween, the shim 112 is rigidly secured between the shank 110 and the frame 114.

After the frame 114, the shim 112, and the clamp 108 are rigidly fixed onto the shank 110, the grate 116 can be fastened to the recessed surface 200 of the frame 114 with the fasteners 158 through the grate mount apertures 204, 222 of the grate 116 and the frame 114.

Figure 21:
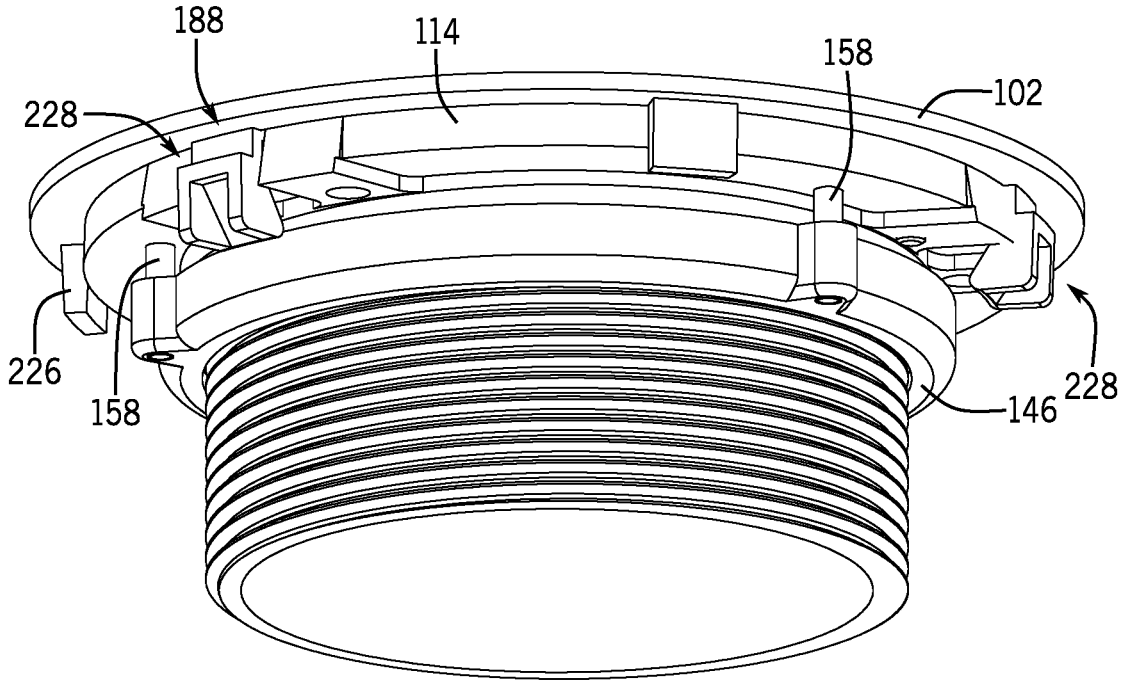
FIG. 21 is a front, bottom perspective view of the floor drain assembly of FIG. 1, partially assembled, including the clamp, the shank, the shim, the frame, the gate, and the cover.

As shown in FIG. 21, once the grate 116 is fastened onto the recessed surface 200 of the frame 114, the cover 102 can be placed over the frame 114 and the grate 116 (if the grate 116 is in place, although it may still be omitted at this stage of assembly). When the cover 102 is placed over the frame 114, it is placed such that each of the bendable tabs 228 slides into a corresponding one of the slots 188 of the frame 114.

Figure 22:
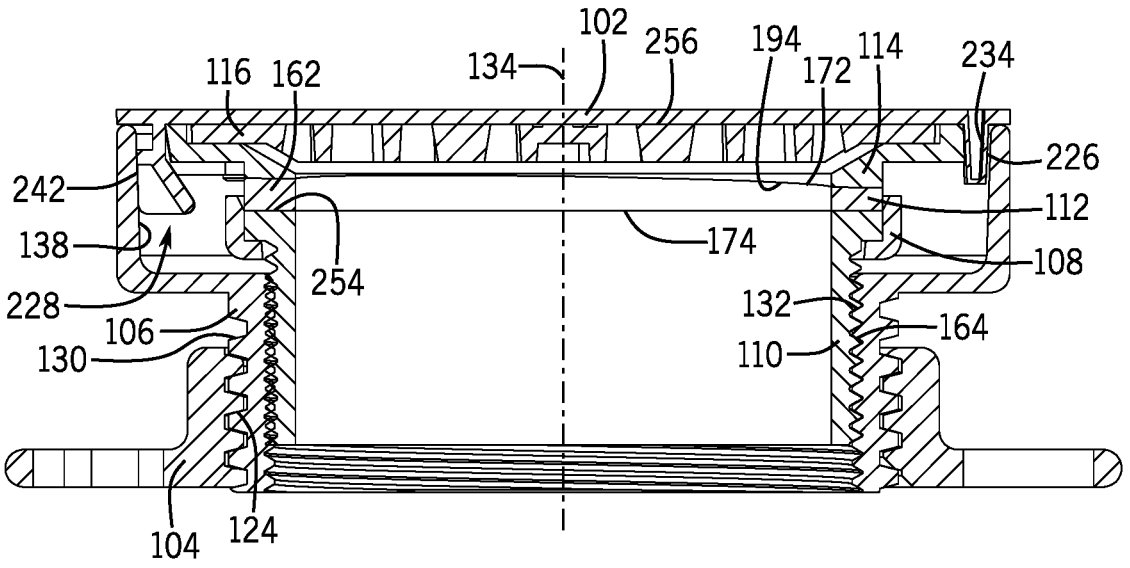
FIG. 22 is a cross-sectional view of the floor drain assembly of FIG. 1, taken along line 22-22.

At this point, the partial assembly, including the clamp 108, the shank 110, the shim 112, the frame 114, the grate 116, and the cover 102, can be coupled to the shroud 106. To achieve this coupling, the threaded radially outward facing surface 164 of the shank body 160 can be threadably engaged with the threaded radially inward facing surface 132 of the shroud body 126, as shown in FIG. 22.

As the shank body 160 is threaded into the shroud body 126, as discussed above, the shroud engagement surfaces 242 of the bendable tabs 228 of the cover 102 each contact the angled inner surface 138 of the upper bowl 128 of the shroud 106. As the shank body 160 is threaded further into the shroud body 126, the bendable tabs 228 are forced to bend radially inward by the angled inner surface 138. This bending results in the bendable tabs 228 bending around the frame 114, within the slots 188, thereby locking the cover 102 onto the frame 114.

Lastly, after the shank 110 has been threadably coupled to the shroud 106, the shroud 106 can be coupled to the base 104. This coupling can be achieved by threadably engaging the threaded radially outward facing surface 130 of the shroud body 126 with the threaded radially inward facing surface 124 of the base body 120. Alternatively, in some instances, the shroud 106 can be coupled to the base 104, as described above, before the shroud 106 is coupled to the shank 110.

Now that the general structure and method of assembling the floor drain assembly 100 have been discussed above, various methods of use will be described below.

Typically, the fully assembled floor drain assembly 100 will be attached to a pipe drain (not shown) in an unfinished flooring surface. Then, cement will generally be poured around the floor drain assembly 100 and allowed to set. The cover 102 prevents the cement from coming into contact with any part of the floor drain assembly 100 other than the base 104 and the shroud 106 during initial installation. After the initial installation, the cover 102 can be removed to allow for fluid to flow through the floor drain assembly 100.

To remove the cover 102, the cover 102, which is rotationally coupled to the frame 114 and thereby rotationally coupled to the shank 110, is rotated to threadably disengage, or screw out, the shank body 160 from the shroud body 126 (typically using a tool which engages the hollow protrusions 226). As the shank body 160 is screwed out of the shroud body 126, the bendable tabs 228 of the cover 102 are allowed to bend back away from the central axis 134 to their original positions as the angled inner surface 138 of the upper bowl 128 of the shroud 106 angles away from the central axis 134. As the bendable tabs 228 return to their original positions, the bendable tabs 228 can eventually be slid past the frame 114, and the cover 102 can be removed from the top of the shank 110.

To aid in the rotation of the cover 102, the central recesses 234 of the hollow protrusions 226 are each configured to receive a tool (not shown). The tool can be any tool with a projecting portion that can fit into one of the central recesses 234, such as, for example, a screw driver. The tool can then be inserted into one of the central recesses 234 and can be used to rotate and remove the cover 102.

Once the cover 102 has been removed from the installed floor drain assembly 100, the shank body 160, as well as the various parts attached to the shank 110, can be screwed back into the shroud body 126 to complete installation of the floor drain assembly 100.

Often times, after installing the floor drain assembly 100, the angular orientation or the height of a top surface 256 of the grate 116 of the floor drain assembly 100 may not align with the surrounding cement floor surface. To address this problem, the floor drain assembly 100 can be independently angularly adjusted with respect to the central axis 134, rotationally adjusted about the central axis 134, or height adjusted along the central axis 134.

To angularly and rotationally adjust the top surface 256 of the grate 116, the shim 112 and the frame 114 can be rotated with respect to each other. This rotation can be achieved by first loosening the fasteners 158 clamping the frame 114 and the clamp 108 onto the shank 110 to allow the frame 114 and the shim 112 to be rotated with respect to the shank 110. In an original orientation, the angled top surface 172 of the shim 112 and the angled bottom surface 194 of the frame 114, which bear on one another, are configured to complement each other, such that the bottom surface 174 of the shim 112 sits flat on the top surface 254 of the lip 162 of the shank 110 while the top surface 256 of the grate 116 sits perpendicular to the central axis 134. By rotating the shim 112 and the frame 114 independently with respect to each other, the angle of the top surface 256 of the grate 116 with respect to the central axis 134 can be changed, such that the grate 116 no longer sits perpendicular to the central axis 134.

After setting a desired angle from the central axis 134, the shim 112 and the frame 114 can be rotated together with respect to the shank 110 about the central axis 134. By rotating the shim 112 and the frame 114 together, the angle at which the grate 116 sits, with respect to the central axis 134, remains unchanged, while the rotational angle about the central axis 134 is altered. This allows both the angle and the direction of the angle to be adjusted independent from the positional height of the shank 110.

In some instances, the shim tab 182 may be used to aid in rotation of the shim 112. For the shim tab 182 to be used, before or after loosening the fasteners 158 clamping the frame 114 and the clamp 108 to the shank 110, the grate 116 may be removed before the shim 112 and frame 114 are adjusted (or may be initially omitted from the assembly and only installed after adjustment). Subsequently, a user or an installer of the floor drain assembly 100 may adjust the shim 112 by grasping the shim tab 182 and rotating the shim 112. Additionally, the shank tab 170 may be used as an initial reference point to be referenced when using the shim tab 182 of the shim 112 to rotate the shim 112. For example, the shim tab 182 may initially be aligned with the shank tab 170. In this instance, when the shim 112 is adjusted, the shank tab 170 can be used as a reference point for the initial rotational position of the shim 112. Once the shim 112 and the frame 114 are in an acceptable final position, the grate 116 can be reattached to the floor drain assembly 100.

To adjust the height of the top surface 256 of the grate 116, the shank body 160 can simply be screwed into or out of the shroud body 126. When the shank body 160 is screwed farther into the shroud body 126, the top surface 256 of the grate 116 is gradually lowered. Alternatively, when the shank body 160 is unscrewed from the shroud body 126, the top surface 256 of the grate 116 is gradually raised. Because the shim 112 and frame 114 can be angularly and rotationally adjusted independent of the height, the height can be adjusted before or after adjusting the angle and rotational position of the top surface 256 of the grate 116.

Once the cover 102 has been removed, and the angle, rotational position, and height have been set such that the top surface 256 of the grate 116 matches the surrounding floor surface, the upper bowl 128 of the shroud 106 can be filled with grout to finalize the installation process of the floor drain assembly 100. After the grout has set within the upper bowl 128 of the shroud 106, the floor drain assembly 100 is fully installed and can be viewed as ready for use.

FIGS. 23-26 illustrate a second embodiment of a floor drain assembly 400 in accordance with the present disclosure. The second embodiment includes generally similar features as the first embodiment but also has the at least the following distinguishing features: an angled inner surface 438 on the shroud 406 for engaging the legs 442 of the cover 402, an upwardly-facing circumferential recess 440 on the inside of the upper bowl 428 of the shroud 406, retaining tabs 448 (shown in FIG. 26) on the cover 402 for holding shims 451 (which are arcuate wedges in this embodiment which do not extend in a full 360 degree ring, but only, for example 270 degrees), bendable legs 442 on the cover 402, a receiving slot 444 (best seen in FIG. 26) cut out from the structural ribs 446 of the underside of the cover 402 to accommodate placement of the shims 451 in conjunction with the tabs 448, the elimination of the clamp 108, and the addition of mounting apertures to the shank 410 capable of receiving fasteners to connect to the mounting frame 414 in lieu of the lower clamp 108.

Figure 23:
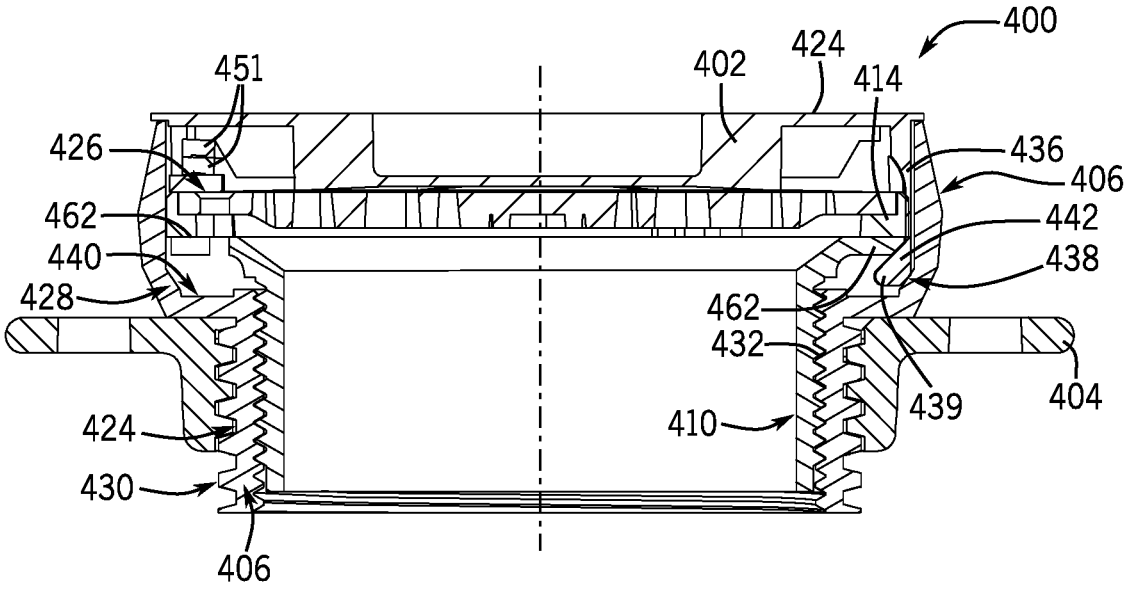
FIG. 23 is a cross-sectional side view taken through the center of a second embodiment of a floor drain assembly.
Figure 24:
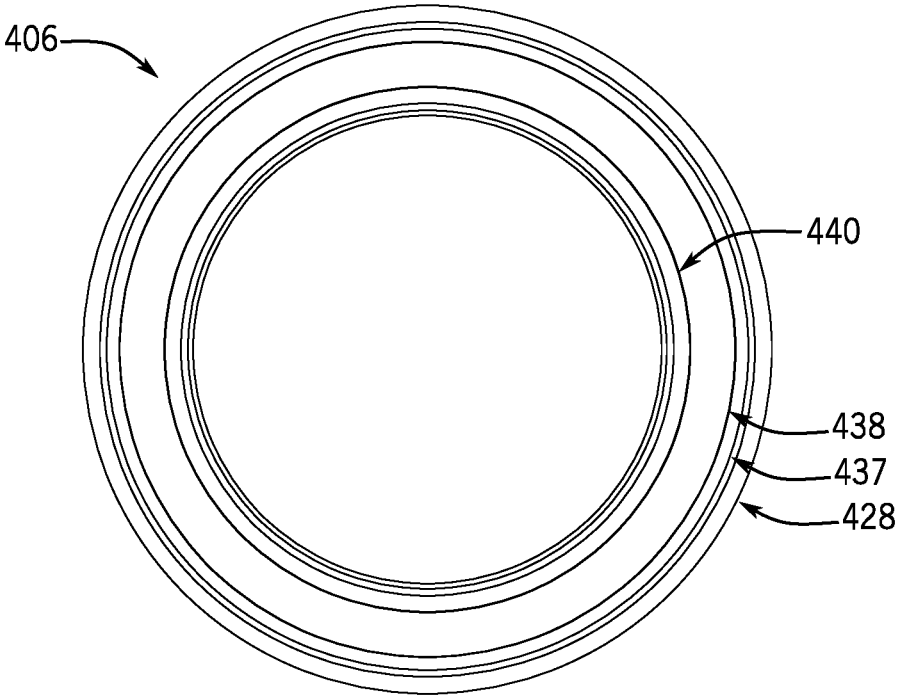
FIG. 24 is a plan view of the shroud of the floor drain assembly of FIG. 23, illustrating the circumferential recess on the horizontal step.
Figure 25:
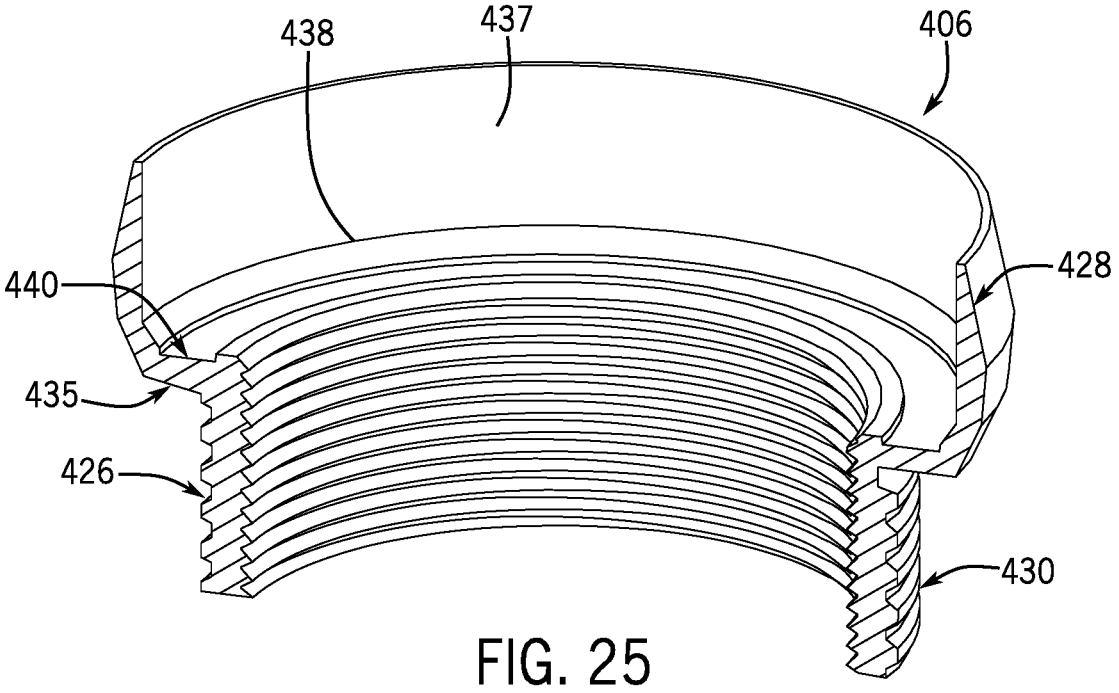
FIG. 25 is a perspective cross-sectional view taken through the shroud illustrating the circumferential recess in profile.

FIG. 23 shows a floor drain assembly 400. Similar to the first embodiment, the second embodiment includes a shroud 406 (which may be metal or plastic) with an upper bowl 428 as best shown in FIGS. 24 and 25. The upper bowl 428 includes a vertical wall 437 that extends axially from an outermost edge of the radially extending wall 435 and circumferentially around the entire radially extending wall 435. Rather than including a gradual angled inner surface 138 that extends a substantial vertical distance as presented in the first embodiment, the second embodiment includes an upper portion of the vertical wall 437 that remains parallel with respect to the central axis 434 until it reaches an angled surface 438 at the bottom of the upper bowl 428. The angled surface 438 tilts downward and centrally toward the axis and is adapted for engagement with the bottoms of the legs 442.

FIGS. 24 and 25 show the shroud 406 apart from the floor drain assembly. The shroud 406 in the second embodiment differs from the first embodiment by including a circumferential recess 440 in the radially extending wall 435. In some non-limiting examples, the circumferential recess 440 can contain a single groove, or a plurality of grooves. The circumferential recess 440 may be used to provide a tortuous path or a moat in order to prevent debris, concrete slurry, and/or water, for example, from entering the space between the shank 410 and the shroud 406 of the drain assembly 400 during assembly. In the absence of a groove or grooves, debris, concrete slurry, and/or other fluids or solids might more freely flow further into the drain assembly than with the groove(s).

Figure 26:
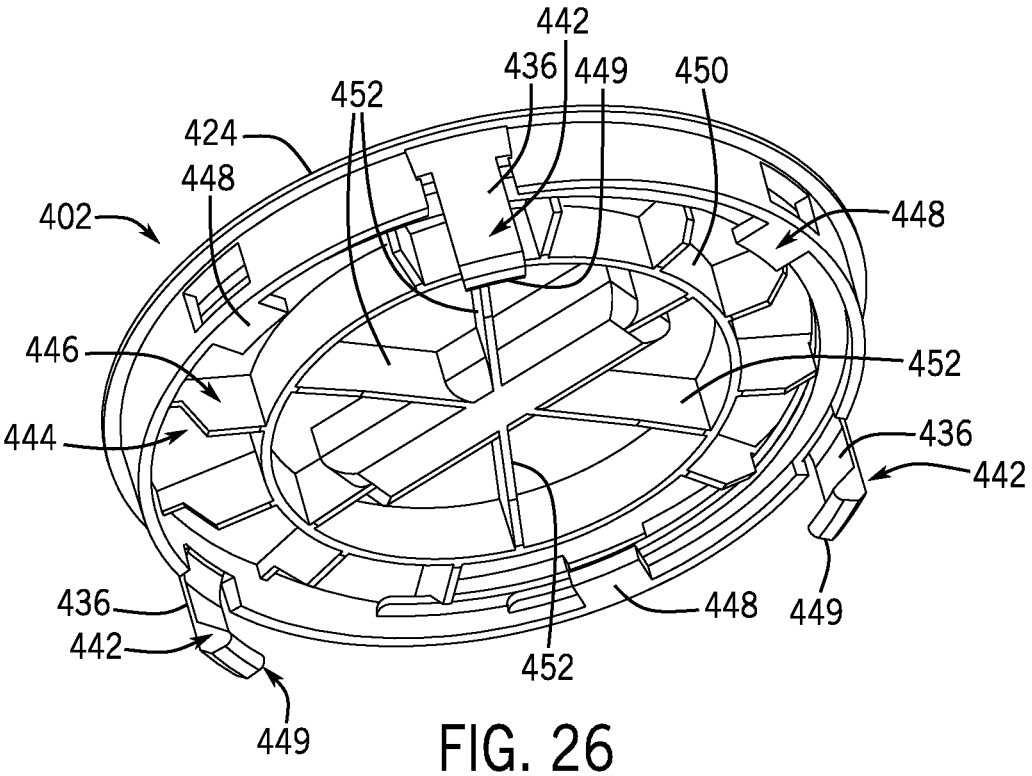
FIG. 26 is a lower side perspective view of the cover from FIG. 25, showing the legs and ribs (with a cutout section removed) on the underside of the cover.

FIG. 26 shows the cover 402 of the second embodiment with some variations. Similar to the first embodiment, the cover 402 includes a cover plate 424 and three bendable legs 442. The bendable legs 442 differ from the first embodiment in that they have longer axial extensions 436 and the exclusion of the angled recess 250 in the design. The bendable legs 442 include a frame engagement portion 449 capable of engaging the frame 414 to the shroud 406.

The cover 402 further includes retaining tabs 448 that are used to support and store the shims 451 within the cover 402 during the assembly of the drain 400. On the underside of the cover 402, there are a plurality of radially extending ribs 446 that have a receiving slot 444 formed therein by the shaping of the lower edge of the rib 446. The shims 451 may be interposed and stored in the circumferentially extending space of the cover 402 above the tabs 448 and within the slots 444 formed in the ribs 446. When the cover 402 is removed, the shims 451 can be removed and inserted between the frame 414 and the upper lip 462 of the shank 410 to angle the strainer as desired, if such angling is necessary. Again, in this form, fasteners may directly connect the frame 414 to the shank 410 to capture the shims 451 therebetween.

It should be appreciated that the configuration of the plurality of radially extending ribs 446, an annular rib 450, and a plurality of central radially extending ribs 452, all disposed on the underside of the cover 402, allows for the cover 402 to be made of a polymeric material, while still being able to withstand a load of approximately three thousand pounds.

Figure 27:
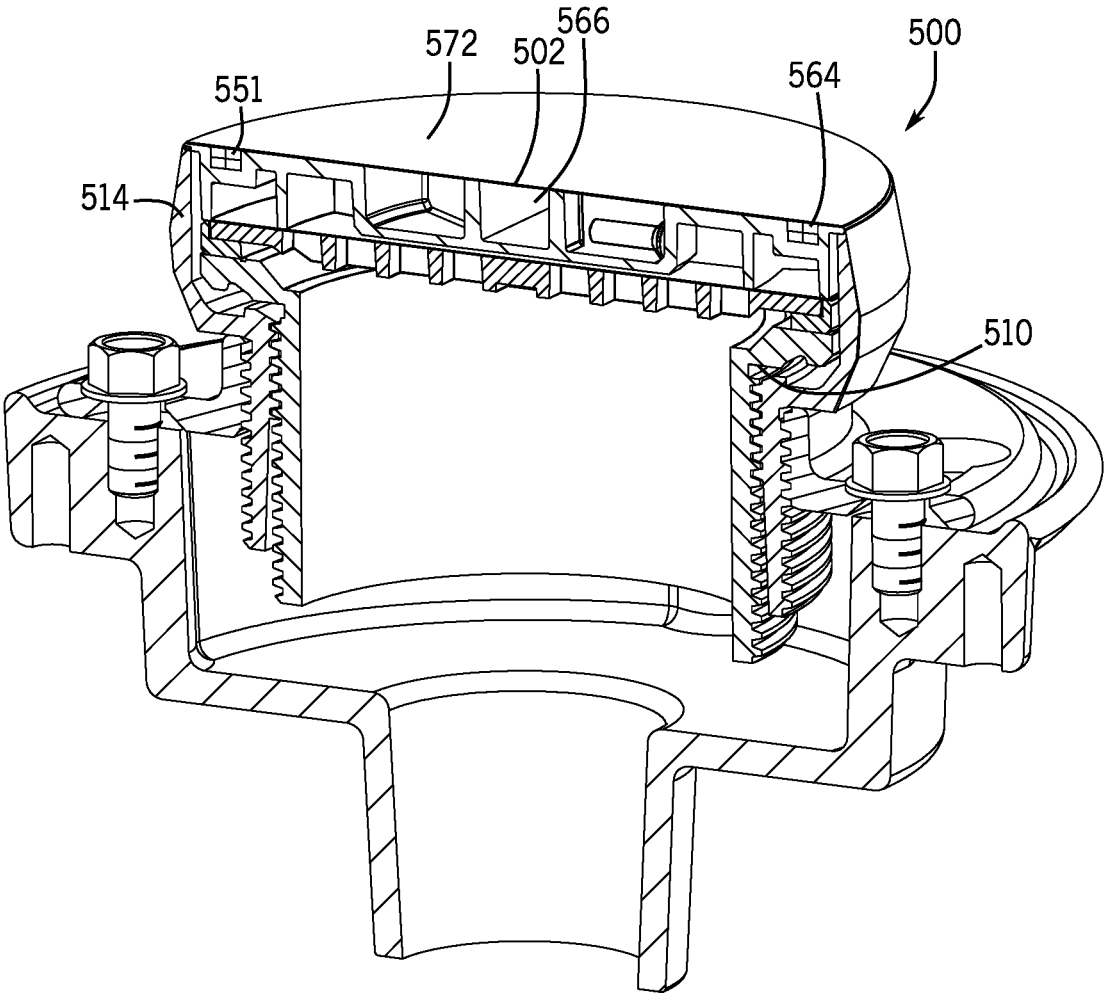
FIG. 27 is a perspective cross-sectional view of a third embodiment of a floor drain assembly, taken through the center of the floor drain assembly, illustrating the storage of a shim on the top of the cover which is covered by a sticker/label.
Figure 28:
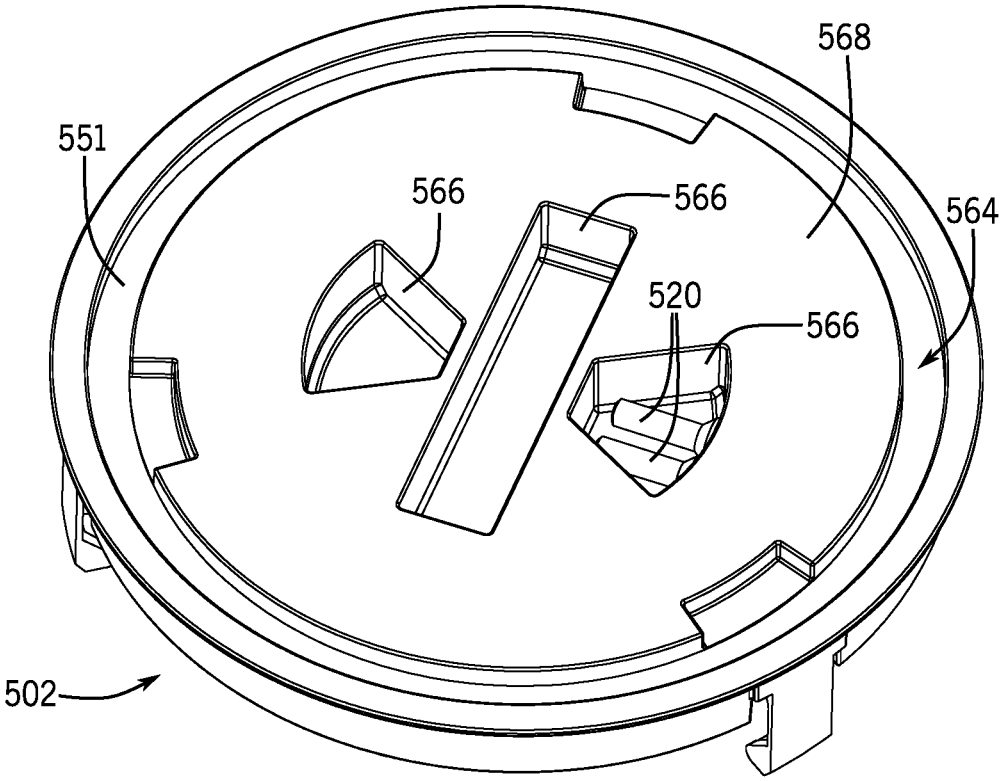
FIG. 28 is front, top perspective view of the cover of the floor drain assembly of FIG. 27 with the sticker/label peeled away.

FIGS. 27 and 28 illustrate a third embodiment of a floor drain assembly 500 in accordance with the present disclosure. The floor drain assembly 500 includes generally similar features to the floor drain assembly 400, and similar features are labeled with similar numbers (e.g., cover 402 and cover 502, shank 410 and shank 510). The floor drain assembly 500, however, also includes variations, including some related to the manner of storage of the shim in the cover, which are described in the subsequent paragraphs.

Referring now to FIGS. 27 and 28, the cover 502 of the floor drain assembly 500 includes a peripheral storage recess 564 and central storage recesses 566. The peripheral storage recess 564 is recessed into an upper surface 568 of the cover 502 and extends circumferentially around the upper surface 568, proximate the periphery of the cover 502. The peripheral storage recess 564 is additionally configured to receive the shim 551, and in some instances can be configured to receive additional shims of varying sizes and angulations. The central storage recesses 566 are recessed into the upper surface 568, proximate the center of the cover 502, and are configured to receive bolts 570 or other installation hardware, which can be used during installation of the floor drain assembly 500.

Returning now to FIG. 27, the shim 551 (or shims) and the bolts 570 can be secured within their corresponding storage recesses 564, 566 by an adhesive secondary cover 572, which can be adhered to the upper surface 568 of the cover 502.

Once the floor drain assembly 500 is installed with the cover 502 in place, the adhesive secondary cover 572 can then be removed or peeled away and the shim 551 (or shims) can be removed from the peripheral storage recess 564 to be used in a similar fashion to the shim 112 of the floor drain assembly 100. Additionally, the bolts 570 can be removed and used to secure the frame 514 to the shank 510.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A drain assembly comprising:

a shroud having a threaded radially inward facing surface;

a shank having a cylindrical radially inward facing surface defining a central axis, and a threaded radially outward facing surface configured to threadably engage the threaded radially inward facing surface of the shroud;

a grate defining a plurality of openings;

a frame positioned axially between the shank and the grate, the frame including a recessed surface configured to receive at least a portion of the grate therein; and a cover positioned such that a plane oriented normal to the central axis will pass through the grate, the frame, and the cover at the same time.

2. The drain assembly of claim 1, wherein the grate and frame are rigidly coupled to the shank.

3. The drain assembly of claim 1, wherein the cover includes a top surface and a bottom surface, and wherein the cover includes at least one structural rib extending from the bottom surface.

4. The drain assembly of claim 1, wherein the cover includes an annular rib disposed on the underside thereof.

5. The drain assembly of claim 4, wherein the cover includes a plurality of radially extending ribs on the underside thereof.

6. The drain assembly of claim 1, further comprising at least one radial rib extending from the underside thereof.

7. The drain assembly of claim 1, wherein the cover is removable.

8. The drain assembly of claim 1, wherein the cover is removable.

9. The drain assembly of claim 1, wherein an axis oriented parallel to the central axis will pass through the grate, the frame, and the cover.

10. The drain assembly of claim 1, wherein the frame is attached to the shank.

11. A drain assembly comprising:

a shroud having a threaded radially inwardly facing surface;

a shank having a cylindrical radially inward facing surface defining a central axis, and a threaded radially outward facing surface configured to threadably engage the threaded radially inward facing surface of the shroud;

a grate defining a plurality of openings;

a frame including a recessed surface configured to receive at least a portion of the grate therein; and a cover positioned such that the grate and the frame are positioned axially between the shank and the cover, wherein the cover is configured to selectively cover at least one opening of the plurality of openings of the grate, wherein the cover includes a top surface and a bottom surface, and wherein the cover includes at least one protrusion extending from the bottom surface.

12. The drain assembly of claim 11, wherein the cover is removable.

13. The drain assembly of claim 11, wherein the cover includes at least one reinforcing rib extending from the bottom surface.

14. The drain assembly of claim 11, further including a recess formed into the top surface.

15. A drain assembly comprising:

a shroud having a threaded radially inwardly facing surface;

a shank having a cylindrical radially inwardly facing surface defining a central axis, and a threaded radially outward facing surface configured to threadably engage the threaded radially inward facing surface of the shroud;

a cover including a top surface and a bottom surface, wherein the cover includes at least a portion of an annular rib and a radially extending rib extending from the bottom surface;

a grate defining a plurality of openings positioned axially between the cover and the shank; and a frame positioned axially between the shank and the grate and including a recessed surface configured to receive at least a portion of the grate therein, and wherein the cover, grate, and frame are all attached to the shank.

16. The drain assembly of claim 15, wherein the cover covers at least one opening of the grate.

17. The drain assembly of claim 15, wherein the cover is configured to prevent material from coming into contact with the frame and the grate.

18. The drain assembly of claim 15, wherein the cover, grate, and frame are rotationally fixed relative to one another.

* * * * *